US010371077B2

(12) United States Patent
Kleist et al.

(10) Patent No.: US 10,371,077 B2
(45) Date of Patent: Aug. 6, 2019

(54) SYSTEMS AND METHODS TO REGULATE DYNAMIC SETTINGS FOR ENGINE SPEED CONTROL MANAGEMENT

(71) Applicants: Dylan Scott Kleist, Bellingham, WA (US); Victor Luis Perez, Bellingham, WA (US); Charles Wayne Reinhardt Swart, Bellingham, WA (US)

(72) Inventors: Dylan Scott Kleist, Bellingham, WA (US); Victor Luis Perez, Bellingham, WA (US); Charles Wayne Reinhardt Swart, Bellingham, WA (US)

(73) Assignee: PACCAR Inc, Bellevue, WA (US)

( * ) Notice: Subject to any disclaimer, the term of this patent is extended or adjusted under 35 U.S.C. 154(b) by 174 days.

(21) Appl. No.: 15/669,657

(22) Filed: Aug. 4, 2017

(65) Prior Publication Data

US 2019/0040813 A1 Feb. 7, 2019

(51) Int. Cl.

| | |
|---|---|
| ***F02D 41/24*** | (2006.01) |
| ***F02D 41/22*** | (2006.01) |
| ***F02D 9/10*** | (2006.01) |
| ***F02D 41/00*** | (2006.01) |

(52) U.S. Cl.

CPC ..... *F02D 41/22* (2013.01); *F02D 9/105* (2013.01); *F02D 41/0097* (2013.01); *F02D 2200/101* (2013.01); *F02D 2200/501* (2013.01)

(58) Field of Classification Search

CPC ..... F02D 41/22; F02D 41/0097; F02D 9/105; F02D 2200/501; F02D 2200/101

USPC ..... 123/399, 436; 701/103, 110; 73/114.25

See application file for complete search history.

(56) References Cited

U.S. PATENT DOCUMENTS

| | | | |
|---|---|---|---|
| 4,569,255 | A | 2/1986 | Holmes |
| 4,573,440 | A | 3/1986 | Pischke et al. |
| 4,630,508 | A | 12/1986 | Klatt |
| 4,631,515 | A | 12/1986 | Blee et al. |
| 4,632,231 | A | 12/1986 | Hattori et al. |
| 4,723,215 | A | 2/1988 | Hibino et al. |

(Continued)

FOREIGN PATENT DOCUMENTS

| | | | |
|---|---|---|---|
| DE | 36 18 844 | A1 | 12/1987 |
| DE | 196 19 324 | A1 | 4/1997 |

(Continued)

OTHER PUBLICATIONS

International Search Report and Written Opinion dated Nov. 22, 2018, issued in corresponding International Application No. PCT/US2018/045209, filed Aug. 3, 2018, 9 pages.

(Continued)

*Primary Examiner* — Hai H Huynh

(74) *Attorney, Agent, or Firm* — Christensen O'Connor Johnson Kindness PLLC

(57) ABSTRACT

In some embodiments, a vehicle is provided having improved fuel economy by using gradual engine speed control. Once a governor activation threshold is crossed, a dynamic engine speed limit that gradually increases over time is implemented. In some embodiments, if the engine speed does not continue to rise over time, increases in the dynamic engine speed limit may be paused. In some embodiments, if the engine speed increases at too great of a rate for too long of a time, the dynamic engine speed limit may be reset. In some embodiments, increasing, pausing, and/or resetting the dynamic engine speed limit allows gradual acceleration while also avoiding torque lock.

20 Claims, 13 Drawing Sheets

(56) References Cited

U.S. PATENT DOCUMENTS

| | | | |
|---|---|---|---|
| 4,853,673 | A | 8/1989 | Kido et al. |
| 4,905,544 | A | 3/1990 | Ganoung |
| 4,947,331 | A | 8/1990 | Speranza |
| 5,067,460 | A | 11/1991 | Van Duyne |
| 5,393,277 | A | 2/1995 | White et al. |
| 5,544,056 | A | 8/1996 | Seireg et al. |
| 5,732,676 | A | 3/1998 | Weisman et al. |
| 5,995,896 | A | 11/1999 | Depping et al. |
| 6,021,370 | A | 2/2000 | Bellinger et al. |
| 6,042,505 | A | 3/2000 | Bellinger |
| 6,176,812 | B1 | 1/2001 | Taki et al. |
| 6,298,300 | B1 | 10/2001 | Ohyama et al. |
| 6,356,831 | B1 | 3/2002 | Michelini et al. |
| 6,813,550 | B2 | 11/2004 | Minami |
| 7,052,434 | B2 | 5/2006 | Makino |
| 7,454,962 | B2 | 11/2008 | Nishiyama et al. |
| 7,646,289 | B2 | 1/2010 | Tamai et al. |
| 7,680,575 | B2 | 3/2010 | Han et al. |
| 8,406,971 | B2 | 3/2013 | Balton et al. |
| 8,587,423 | B2 | 11/2013 | Olsen et al. |
| 2005/0215394 | A1 | 9/2005 | Bolander et al. |
| 2008/0058159 | A1 | 3/2008 | Watanabe et al. |
| 2009/0157267 | A1 | 6/2009 | Shin et al. |
| 2009/0299560 | A1 | 12/2009 | Tomatsuri et al. |
| 2010/0036571 | A1 | 2/2010 | Han et al. |
| 2013/0261846 | A1 | 10/2013 | McQuade et al. |
| 2014/0121933 | A1 | 5/2014 | Slaton et al. |

FOREIGN PATENT DOCUMENTS

| | | | |
|---|---|---|---|
| JP | 11-257112 | A | 9/1999 |
| KR | 20030038899 | A | 5/2003 |
| KR | 20040056712 | A | 7/2004 |
| WO | 83/01686 | A1 | 5/1983 |
| WO | 2008/042597 | A2 | 4/2008 |

OTHER PUBLICATIONS

International Search Report and Written Opinion dated Apr. 20, 2012, issued in corresponding International Application No. PCT/US2011/050371, filed Sep. 2, 2011, 7 pages.

Extended European Search Report dated Jul. 12, 2016, issued in European Application No. 11822734.7, filed Sep. 2, 2011, 10 pages.

Communication Pursuant to Article 94(3) EPC dated Mar. 30, 2017, issued in European Application No. 11822734.7, filed Sep. 2, 2011, 7 pages.

Communication Pursuant Article 94(3) EPC dated Feb. 6, 2018, issued in corresponding European Application No. 11822734.7, filed Sep. 2, 2011, 7 pages.

SYSTEMS AND METHODS TO REGULATE DYNAMIC SETTINGS FOR ENGINE SPEED CONTROL MANAGEMENT

BACKGROUND

Inefficient uses of vehicles can result in higher fuel consumption than is needed and, thus, may result in increased operating costs. In the field of surface transportation, and particularly in the long-haul trucking industry, even small improvements in fuel efficiency can reduce annual operating costs significantly.

Over the years, numerous advances have been made to improve fuel efficiency in internal combustion powered vehicles. In many situations, fuel consumption may be reduced by operating the vehicle at lower engine speeds. Techniques for influencing driver shifting strategies have been identified as being useful for reduce fuel consumption. For instance, a visual signal, such as a shift light on a dashboard, may be illuminated when a driver has reached a maximum engine speed, encouraging the driver to shift sooner than the driver would have without the visual signal. Another known technique includes the use of an engine speed governor that prevents the engine from rotating above a predetermined engine speed. This technique, however, may be too limiting to the driver for some applications and thus, may frustrate the driver and restrict the driver's ability to control the vehicle.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In some embodiments, a vehicle is provided. The vehicle comprises an engine, a set of sensors, and an electronic control unit (ECU). The engine includes an engine electronic control unit (engine ECU). The set of sensors includes an engine speed sensor, a vehicle speed sensor, and a throttle position sensor. The ECU is communicatively coupled to the engine ECU and the sensors. The ECU is configured to calculate and provide engine speed limit values to the engine ECU. Calculating engine speed limit values includes detecting that an engine speed has increased beyond a governor activation threshold value; determining a dynamic engine speed limit; determining whether conditions for applying the dynamic engine speed limit are met; and, while the conditions for applying the dynamic engine speed limit are met, repeatedly updating the dynamic engine speed limit to a subsequent dynamic engine speed limit. Updating the dynamic engine speed limit includes determining a current engine speed value; using a previous dynamic engine speed limit as the subsequent dynamic engine speed limit in response to determining that the current engine speed value is between the governor activation threshold value and an offset dynamic engine speed limit; using a new dynamic engine speed limit as the subsequent dynamic engine speed limit in response to determining that the current engine speed value is between the previous dynamic engine speed limit and the offset dynamic engine speed limit; and transmitting the subsequent dynamic engine speed limit to the engine ECU of the engine for implementation.

In some embodiments, a method of adjusting an engine speed limit for an engine of a vehicle is provided. The method is executed by an electronic control unit (ECU). A detection occurs that an engine speed has increased beyond a governor activation threshold value. A dynamic engine speed limit is determined. A determination is made regarding whether conditions for applying the dynamic engine speed limit are met. While the conditions for applying the dynamic engine speed limit are met, the dynamic engine speed limit is repeatedly updated to a subsequent dynamic engine speed limit. Updating the dynamic engine speed limit includes using a previous dynamic engine speed limit as the subsequent dynamic engine speed limit in response to determining that the current engine speed value is between the governor activation threshold value and an offset dynamic engine speed limit; using a new dynamic engine speed limit as the subsequent dynamic engine speed limit in response to determining that the current engine speed value is between the previous dynamic engine speed limit and the offset dynamic engine speed limit; and transmitting the subsequent dynamic engine speed limit to an engine electronic control unit (engine ECU) of the engine for implementation.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
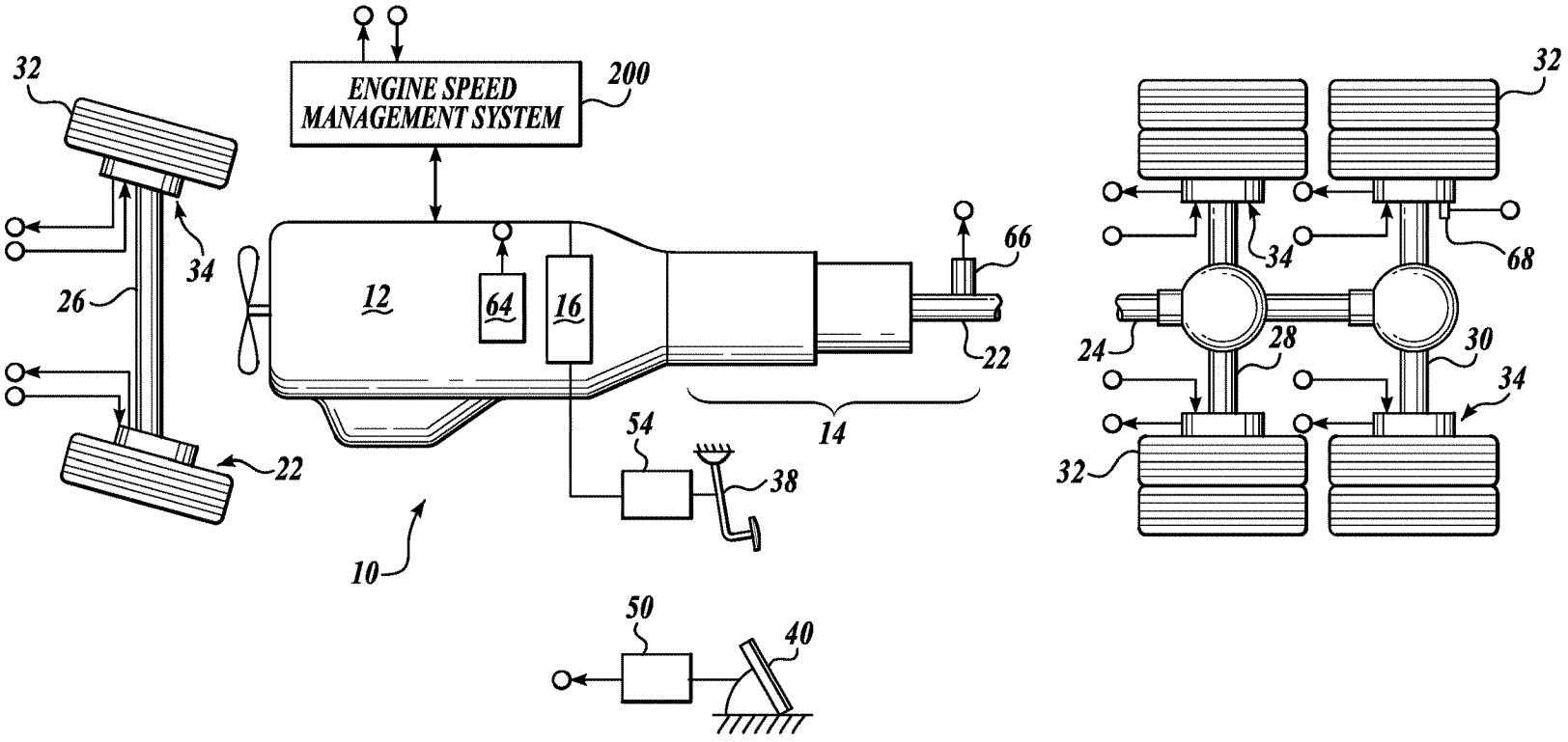
FIG. 1 is a schematic diagram of a vehicle 10, such as a Class 8 tractor, suitable for comprising a speed management system 200 in accordance with various embodiments of the present disclosure.

The detailed description set forth below in connection with the appended drawings where like numerals reference like elements is intended only as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

The following discussion proceeds with reference to examples of speed control management systems and methods suitable for use in vehicles having manual transmissions, such as Class 8 trucks. Generally, the examples of the speed control management systems and methods described herein aim to control the acceleration of the vehicle in certain situations, which may in turn, influence driver shifting strategies. For example, the amount of fuel consumed is at least partially dependent on the speed of the engine. As such, improvements in fuel efficiency can be realized if the engine's speed is maintained within a "sweet spot" or optimal range for a given transmission gear ratio. To potentially influence driver shifting strategies that, in turn, may increase fuel efficiency through a reduction in engine speed, the speed of the engine is limited in certain situations, such as when the engine speed is above the "optimal" range for the current transmission ratio.

In some embodiments, the torque generated by the engine is limited by a reduction in fuel, air, or combination of fuel and air supplied to the engine as the engine's speed increases. By limiting the fuel and/or air supplied to the engine when the engine speed is above the optimal range, the rate in which the driver may increase vehicle speed (i.e., acceleration) is restricted. As a result, the driver may be more likely to shift into a more appropriate gear for the current driving conditions. In some embodiments, an engine speed limit may be set by an engine speed management system and supplied to a controller of the engine via a standardized control signal to be implemented using any suitable technique.

Although exemplary embodiments of the present disclosure will be described hereinafter with reference to Class 8 trucks, it will be appreciated that aspects of the present disclosure have wide application, and therefore, may be suitable for use with many types of mechanically powered or hybrid powered vehicles having manual transmissions, such as passenger vehicles, buses, commercial vehicles, light and medium duty vehicles, etc. Accordingly, the following descriptions and illustrations herein should be considered illustrative in nature, and thus, not limiting the scope of the claimed subject matter.

Prior to discussing the details of various aspects of the present disclosure, it should be understood that several sections of the following description are presented largely in terms of logic and operations that may be performed by electronic components. These electronic components, which may be grouped in a single location or distributed over a wide area, generally include processors, memory, storage devices, display devices, input devices, etc. It will be appreciated by one skilled in the art that the logic described herein may be implemented in a variety of hardware, software, and combination hardware/software configurations, including but not limited to, analog circuitry, digital circuitry, processing units, and the like. In circumstances were the components are distributed, the components are accessible to each other via communication links.

In the following description, numerous specific details are set forth in order to provide a thorough understanding of example embodiments of the present disclosure. It will be apparent to one skilled in the art, however, that many embodiments of the present disclosure may be practiced without some or all of the specific details. In some instances, well known process steps have not been described in detail in order not to obscure unnecessarily various aspects of the present disclosure. Furthermore, it will be appreciated the embodiments of the present disclosure may employ any of the features described herein.

As briefly described above, embodiments of the present disclosure are directed to engine speed management systems and methods for improving fuel economy by optimizing and influencing driver shifting through gradual engine speed control. FIG. 1 is a schematic diagram of a vehicle 10, such as a Class 8 tractor, suitable for comprising a speed management system 200 in accordance with various embodiments of the present disclosure. Although a vehicle such as depicted in FIG. 1 represents one of the possible applications for the systems and methods of the present disclosure, it should be appreciated that aspects of the present disclosure transcend any particular type of vehicle employing an internal combustion engine (e.g., gas, diesel, etc.) or hybrid drive train.

The vehicle 10 in the embodiment shown in FIG. 1 may include an electronically controlled engine 12 coupled to a manual transmission 14 via a clutch mechanism 16. The manual transmission 14 may include an input shaft (not shown) and an output shaft 22 coupled to a drive shaft 24. The vehicle 10 includes at least two axles such as a steer axle 26 and at least one drive axle, such as axles 28 and 30. Each axle supports corresponding wheels 32 having service brake components 34 for monitoring the vehicle's operating conditions and to effect control of the vehicle braking system. The vehicle 10 may also include conventional operator control inputs, such as a clutch pedal 38 and an accelerator pedal 40. The vehicle 10 may also include a variety of sensors, such as an accelerator pedal position sensor 50, a clutch pedal position sensor 54, an engine speed sensor 64, an output shaft sensor 66, and wheel speed sensor 68. As indicated above, the vehicle 10 is further equipped with an engine speed management system 200 that interfaces with the engine 12 and the various sensors described herein. As will be further described below, the engine speed management system 200 may be configured to limit the speed of the engine 12 to influence driver shifting strategies.

Figure 2A:
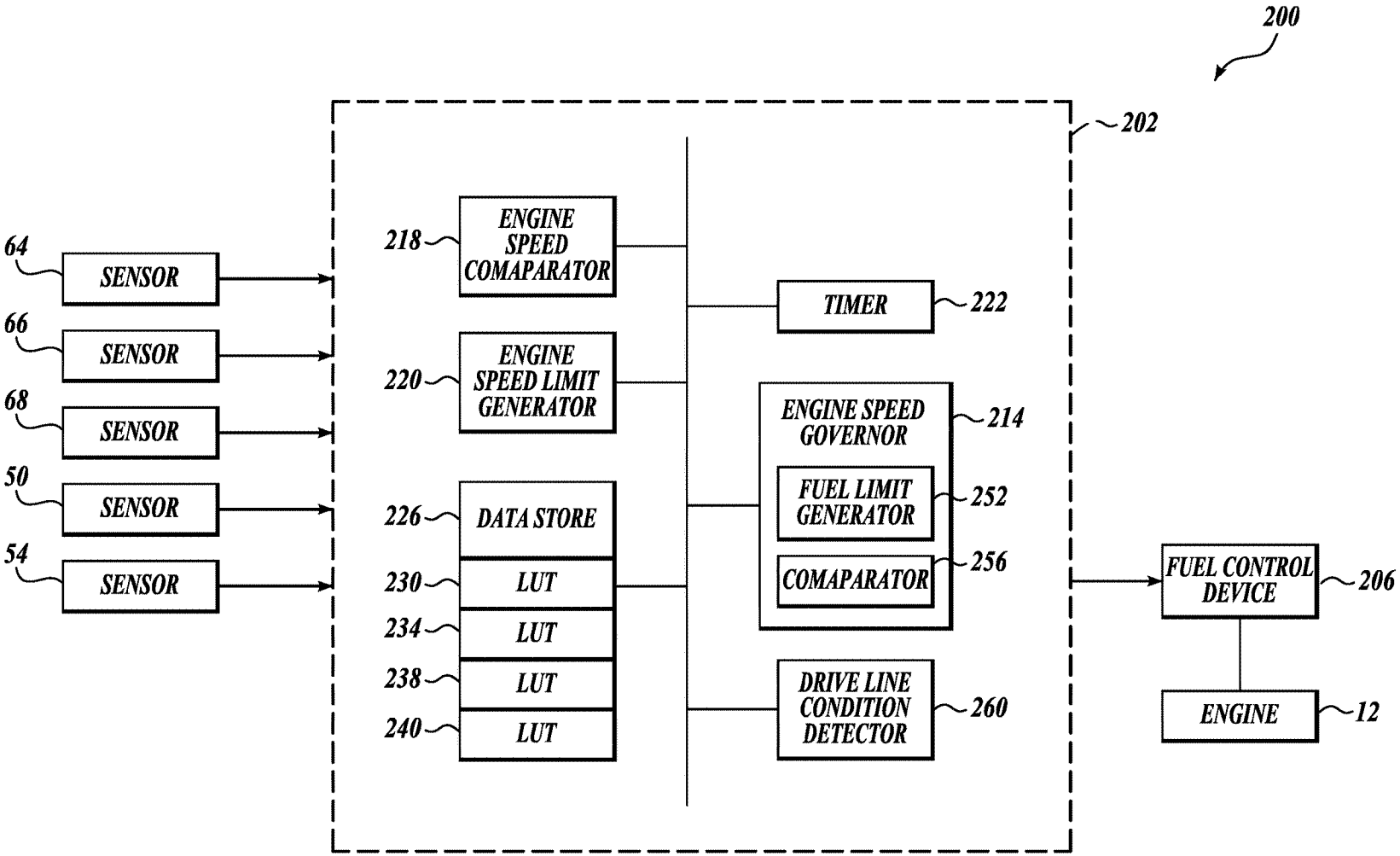
FIG. 2A is a functional block diagrammatic view of one example of a speed management system in accordance with various aspects of the present disclosure.

FIG. 2A is a functional block diagrammatic view of one example of a speed management system 200 in accordance with various aspects of the present disclosure. As shown in FIG. 2A, the speed management system 200 may include an electronic control unit (ECU) 202 communicatively coupled to a plurality of sensors, including but not limited to the accelerator pedal position sensor 50, the clutch pedal position sensor 54, the engine speed sensor 64, the output shaft sensor 66, and/or wheel speed sensors 68. In some embodiments, the ECU 202 can also be communicatively coupled to a fuel control device 206. The fuel control device 206 may be associated with the engine 12 for selectively supplying fuel thereto. In some embodiments, the fuel control device 206 may be configured to control the amount of fuel supplied to the engine 12 and thus the speed of the engine 12 in response to signals generated by the ECU 202. In some embodiments, the ECU 202 may provide an engine speed limit value directly to an engine controller, which will then convert the engine speed limit value into a fuel amount or other value for controlling the engine speed.

It will be appreciated that the ECU 202 can be implemented in a variety of hardware, software, and combination hardware/software configurations, for carrying out aspects of the present disclosure. In the embodiment shown in FIG. 2A, the ECU 202 may include but is not limited to an engine speed governor 214, an engine speed comparator 218, an engine speed limit generator 220, a timer 222, and a data store 226. In one embodiment, the data store 226 may include an engine speed shift target look up table 230 (LUT 230), an engine speed target slope LUT 234, and a rewriteable memory section for storing current engine speed and/or a current engine speed limit. The engine speed shift target LUT 230 and the engine speed target slope LUT 234 can be generated as a function of transmission gear ratio. In some embodiments, the ECU 202 may not include an engine speed governor 214 if, for example, the ECU 202 provides an engine speed limit value directly to an engine controller for enforcement.

In some embodiments, the data store 226 may additionally include an optional engine speed shift target offset LUT 238 and an optional engine speed shift target offset time delay LUT 240. The engine speed shift target offset LUT 238 and the engine speed shift target offset time delay LUT 240 can be generated as a function of engine speed and transmission gear ratio.

Upon a determination from the engine speed comparator 218 that current engine speed is greater than a governor activation threshold value obtained from LUT 230 based on the current transmission gear ratio, the engine speed limit generator 220 determines an engine speed limit as a function of time, referred to as the dynamic engine speed limit. The dynamic engine speed limit provides engine speed limits that may increase over time, as described further below. In some embodiments, the dynamic engine speed limit (DESL) may be calculated from the following formula:

$$\text{DESL}=\text{Stored Engine Speed(SES)}+\text{Engine Speed Target Slope}*\text{Time Since Activation} \qquad \text{Formula (1)}$$

By increasing engine speed limits as a function of time, an engine speed may be gradually limited, thus providing a driver an indication to shift in order to optimize fuel efficiency while still allowing the driver to increase engine speed after receiving the indication to shift.

As described briefly above, the dynamic engine speed limit and the engine speed target slope may be determined as a function of current transmission gear ratio. It will be appreciated that such a ratio may be obtained in a variety of ways. In some embodiments, the current transmission gear ratio may be calculated as the ratio of engine speed to transmission output shaft speed or drive shaft speed. In that regard, the ECU 202 may be configured to receive signals indicative of the engine speed from sensor 64 and transmission output shaft speed from sensor 66. Other techniques for obtaining the current transmission gear ratio may be practiced with embodiments of the present disclosure. In some embodiments, the engine speed target slope may be calculated as follows:

Given:
Transmission gear ratio=Tr;
Rear axle ratio=Ar;
Vehicle mass=M;
Coefficient of aerodynamic drag=Cd;
Vehicle frontal area=A;
Vehicle velocity=V;
Vehicle rolling resistance=Frr;
Engine brake torque over time=T(t);
Engine speed=N;
Tire loaded rolling radius=Rt.

The engine target speed slope can be obtained from:

$$\frac{dV}{dt}=\frac{\frac{T(t)*Tr*Ar}{Rt}-\frac{1}{2}*Cd*A*V^2-Frr}{M} \qquad \text{Formula (2)}$$

For each gear ratio of a specific vehicle at a "loaded" mass and an "unloaded" mass, two curves may be generated. These curves of vehicle acceleration can be converted to engine acceleration by:

$$\frac{dN}{dt}=\frac{\frac{dV}{dt}*Tr*Ar}{Rt*2*\pi} \qquad \text{Formula (3)}$$

Still referring to FIG. 2A, the engine speed limit generator 220 may output the dynamic engine speed limit to the engine speed governor 214, which in turn, outputs a signal to the fuel control device 206 that indicates the fuel quantity to be supplied to the engine 12. Alternatively, the engine speed limit generator 220 may output the dynamic engine speed limit directly to an engine controller to be enforced. In the embodiment shown in FIG. 2A, the engine speed limit generator 220 includes a torque limit generator, such as a fuel limit generator 252, and a comparator 256. Based on the dynamic engine speed limit received from the engine speed limit generator 220, the fuel limit generator 252 generates a fuel limit based on the dynamic engine speed limit and transmits the fuel limit to the comparator 256. The comparator 256 compares the fuel limit to the fuel demand from the driver as indicated by the accelerator pedal position sensor 50, and outputs the lower of the two values to the fuel control device 206.

In some examples, the ECU 202 may be configured to disable the engine speed governor 214 or clear the engine speed limit provided to the engine controller when the vehicle is operating in predetermined operating conditions. For example, the ECU 202 may further include a driveline condition detector 260. If the driveline condition detector 260 determines the driveline is in the open position or that the gear ratio has changed, the driveline condition detector may send a signal to the engine speed governor 214 to selectively disable the engine speed governor 214. To that end, the engine speed governor 214 outputs the driver fuel demand as the fuel quantity value to the fuel control device 206.

Figure 2B:
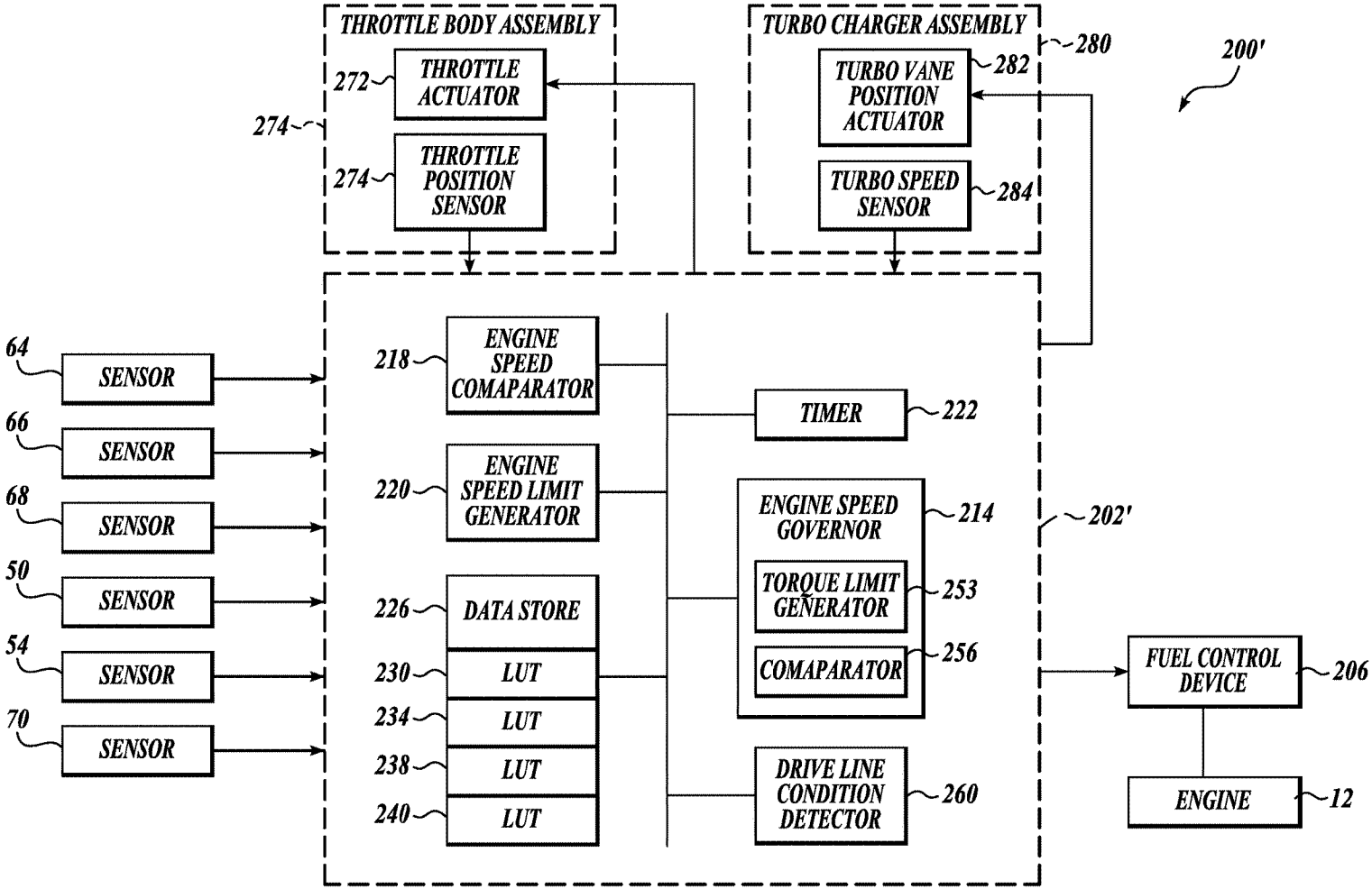
FIG. 2B is a functional block diagrammatic view of another example of a speed management system in accordance with various aspects of the present disclosure.

Turning now to FIG. 2B, another configuration of a speed management system 200' in accordance with aspects of the present disclosure will now be described. The speed management system 200' is substantially similar in construction and operation as the speed management system 200 of FIG. 2A except for the differences that will now be described. As best shown in FIG. 2B, the ECU 202' differs from ECU 202 of FIG. 2A in that ECU 202' of FIG. 2B includes a torque limit generator 253 rather than a fuel limit generator 252. The torque limit generator 253 may be configured to generate a torque limit dependent on the dynamic engine speed limit and transmit the limit to the comparator 256. The torque limit generator 253 may be configured to limit torque by reducing the amount of fuel, air, or a combination thereof supplied to the engine 12. The ECU 202' may be also communicatively coupled to a mass flow sensor 70. The mass flow sensor 70 may be configured to measure a total air flow rate into the engine. In one embodiment, the mass air flow sensor 70 may be positioned in the engine's intake manifold.

In the embodiment shown in FIG. 2B, the speed management system 200' may further include a throttle body assembly 270. As shown, the throttle body assembly 270 may include a throttle actuator 272 and a throttle position sensor 274, both communicatively connected to the ECU 202'. The throttle speed sensor 274 may provide feedback of the position of the throttle actuator 272 to the ECU 202'. The throttle actuator 272 is associated with the engine 12 for selectively supplying air thereto. The throttle actuator 272 may be configured to control the amount of air supplied to the engine 12 and thus the speed of the engine 12 in response to signals generated by the ECU 202'.

In some embodiments, the engine 12 of the vehicle may be optionally turbocharged. In this regard, the speed management system 200' may further include a turbo charger assembly 280. In the embodiment shown, the turbo charger assembly 280 may include a turbo vane position actuator 282 and a turbo speed sensor 284, both communicatively connected to the ECU 202'. The turbo speed sensor 284 outputs signals indicative of the speed of the turbo charger to the ECU 202'. The turbo vane position actuator 282 is associated with the engine 12 for selectively supplying compressed air thereto. As will be explained in more detail below, the turbo vane position actuator 282 may be configured to control the amount of compressed air supplied to the engine 12 and thus the speed of the engine 12 in response to signals generated by the ECU 202'.

Based on the dynamic engine speed limit received from the engine speed limit generator 220, the torque limit generator 253 may be configured to generate an air flow limit and transmit the air flow limit to the comparator 256. The comparator 256 may be configured to compare the air flow limit to that requested from the driver as indicated by the accelerator pedal position sensor 50 and output the lower of the two values to the throttle actuator 272 and/or the turbo vane position actuator 282. It will be further appreciated by those skilled in the art that other methods could be used to control air flow or torque, such as using variable valve timing, cylinder deactivation, intake manifold runner geometry changes, exhaust system valves/brakes, and a variety of other airflow devices. The engine speed governor 214, which may also be referred to a torque governor, further outputs to the fuel control device 206 a signal indicative of the fuel quantity corresponding to the air flow value in accordance with one or more fuel maps stored in data store 226. It will be appreciated that in other embodiments, the torque limit generator 253 may be configured to control the speed of the engine 12 by limiting the amount of fuel or a combination of fuel and air being supplied to the engine 12.

Figure 3:
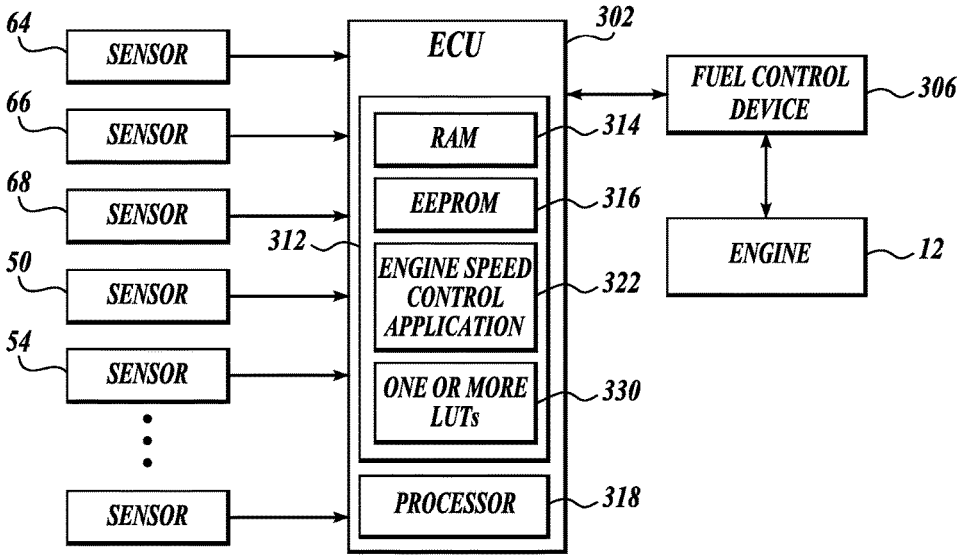
FIG. 3 is a functional block diagram that illustrates further features of an example embodiment of an ECU according to various aspects of the present disclosure.

FIG. 3 is a functional block diagram that illustrates further features of an example embodiment of the ECU according to various aspects of the present disclosure. As best shown in FIG. 3, the ECU 302 may include a memory 312 and a processor 318. In some embodiments the memory 312 comprises a Random Access Memory ("RAM") 314 and an Electronically Erasable, Programmable, Read-Only Memory ("EEPROM") 316. Those skilled in the art and others will recognize that the EEPROM 316 is a non-volatile memory capable of storing data when a vehicle is not operating. Conversely, the RAM 314 is a volatile form of memory for storing program instructions that are accessible by the processor 318. Typically, a fetch and execute cycle in which instructions are sequentially "fetched" from the RAM 314 and executed by the processor 318 is performed. In this regard, the processor 318 is configured to operate in accordance with program instructions that are sequentially fetched from the RAM 314.

The memory 312 may include program modules, applications, and the like that include algorithms configured to perform operations that are executable by the processor 318. In that regard, the memory 312 includes an engine speed control application 322 for controlling acceleration of the vehicle and, possibly as a result, influence driver shifting strategies to promote, for example, fuel efficiency and/or the like. Additionally, the memory 312 may include multi-dimensional performance maps or look-up tables (LUTs) that are accessed by the processor 318.

The engine speed control application 322 includes instructions that when executed by the processor 318 cause the system to perform one or more functions. In some embodiments, the application 318 is capable of polling for or receiving data from one or more system components, analyzing the data received from the system components, and/or generating control signals to be transmitted to the components of the system 300, such as the fuel control device 306 or an engine controller (not shown). The application 322 further accesses stored data, including data from one or more LUTs.

During operation of the vehicle 10, the application 322 is programmed to obtain and/or calculate a ratio indicative of the transmission gear ratio in which the vehicle is currently operating. It will be appreciated that the ratio may be obtained from a variety of ways. In some embodiments, the ECU 302 may be configured to receive signals from a plurality of sensors indicating the operating conditions of the vehicle 10. For instance, one or more sensors may be configured to provide signals to the ECU 302 indicative of vehicle speed, transmission output shaft speed, and/or engine speed, such as via the wheel sensor 68, the output shaft sensor 66 or engine speed sensor 64, respectively. In some embodiments, the processor 318 may be configured to receive signals indicative of the engine speed and transmission output shaft speed or vehicle speed and to determine the gear ratio therefrom. For instance, in some embodiments, the transmission gear ratio is obtained from the ratio of the engine speed to the vehicle speed. In some embodiments, the transmission gear ratio is obtained from the ratio of engine speed to transmission output shaft speed.

The application 322 may be further configured to cause the processor 318 to access one or more LUTs in memory 312 to identify a progressive shift target for the determined gear ratio and to compare the engine's current speed to the progressive shift target. The progressive shift target may be a predetermined engine speed identified as an optimized engine speed for shifting to a next higher gear in order to improve fuel economy, and therefore, may also be referred to as a speed shift target. In the event the current engine speed exceeds the progressive shift target, the application 322 may cause the processor 318 to access an LUT in memory 312 to determine the engine speed limit as a function of time, referred to as the dynamic engine speed limit as described above. In some embodiments, the dynamic engine speed limit may be determined by generating an engine speed control target slope as a function of the determined gear ratio and starting engine speed. In some embodiments, the application 322 retrieve a governor activation threshold value from the LUT in memory 312, and may determine a dynamic engine speed limit and/or engine speed control target slope upon determining that the current engine speed exceeds the governor activation threshold value. In some embodiments, the engine speed control target slope determined once the engine speed crosses the governor activation threshold may be different from the engine speed control target slope determined once the engine speed crosses the progressive shift target.

The application 322 may further cause the processor 318 to determine an engine fuel limit to maintain an engine speed equal to or less than the dynamic engine speed limit at each point in time. The ECU 302, under control of the processor 318, provides a signal indicative of the engine fuel limit at a particular point in time to the fuel control device 306 for reducing the amount of fuel being applied to the engine 12.

In some embodiments, the fuel control device 306 may limit the amount of fuel provided to the engine 12 when the engine fuel limit is less than the fuel request from the driver. In particular, the application 322 may cause the processor 318 to compare the engine fuel limit at each point in time with the fuel requested from the driver as indicated by the accelerator pedal sensor 50. As a result, the ECU 302 may be configured to send a signal indicative of the smaller of the two values to the fuel control device 306. For instance, in the event that the engine fuel limit is less than the fuel request from the driver, a signal indicative of the engine fuel limit at the particular point in time is sent to the fuel control device 306.

In some examples, the ECU 302 may be configured to detect whether the driveline is in the open position or in the closed position. When the driveline is determined to be in the open position, as indicated by, for example, the output of the transmission neutral switch (not shown), the application 322 causes the processor 318 to send a signal indicative of the driver fuel request to the fuel control device 306.

While the embodiment described above implemented the functionality of a speed limit governor, a driveline condition detector, and a comparator as program instructions within application 322, it will be appreciated that one or more of these may be implemented as separate program modules that are accessed by the application 322. Alternatively, it will be appreciated that the logic carried out by one or more of these may be implemented as digital and/or analog circuitry and/or the like. Additionally, it will be appreciated that the ECU 302 may be one or more software control modules contained within an engine control unit of the vehicle, or within one or more general purpose controllers residing on the vehicle.

Figure 4:
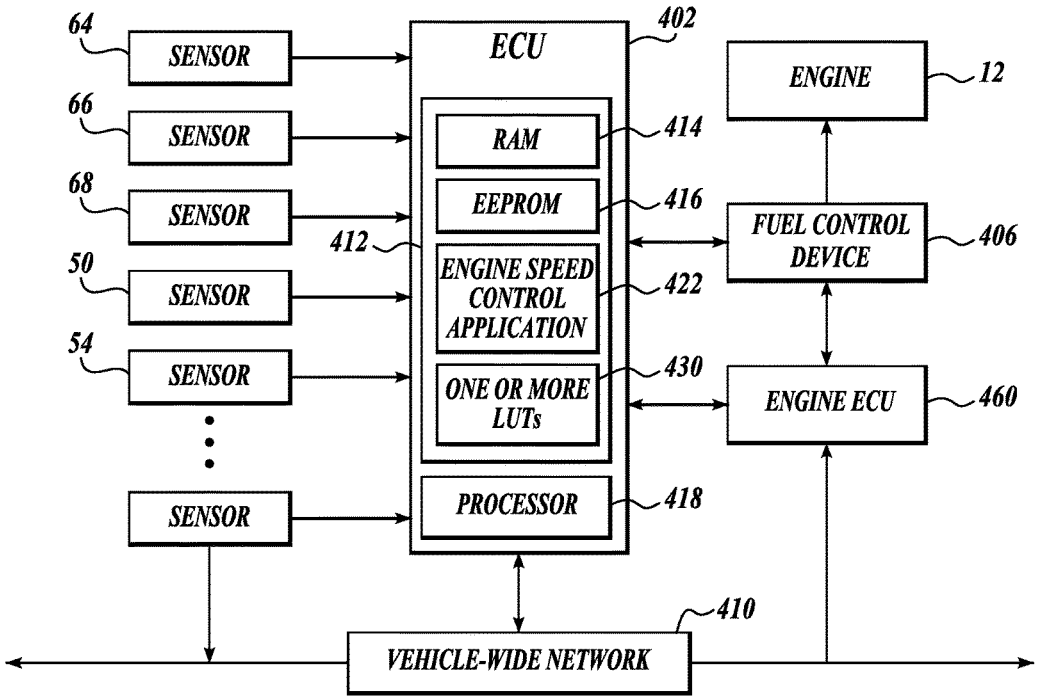
FIG. 4 is a functional block diagrammatic view that illustrates another example of a speed management system in accordance with various aspects of the present disclosure.

FIG. 4 is a functional block diagrammatic view that illustrates another example of a speed management system 400 in accordance with various aspects of the present disclosure. In reference to FIG. 4, the system 400 includes a speed management ECU 402 and an engine ECU 460 coupled to a fuel control device 406. As best shown in FIG. 4, the speed management ECU 402 is connected either directly to the engine ECU 460 or indirectly via a vehicle wide network 410. Similarly, the sensors 404 may be either directly coupled to the speed management ECU 402 or indirectly via the vehicle wide network 410. In the exemplary system shown in FIG. 4, the speed management ECU 402 may also be directly coupled to the fuel control device 406. As such, the signals generated by the speed management ECU 402 may be provided directly to the fuel control device 406 or to the fuel control device 406 via the engine ECU 460 to control the amount of fuel being supplied to the engine 12. In such embodiments, the speed management ECU 402 may determine engine speed limits and provide them to the engine ECU 460 to be enforced via the fuel control device 406.

Those skilled in the art and others will recognize that the speed management system 400 includes a vehicle-wide network 410 for the components within the vehicle to communicate through. Those skilled in the art will recognize that vehicle-wide network 410 may be implemented using any number of different communication protocols such as, but not limited to, Society of Automotive Engineer's ("SAE") J1587, SAE J1922, SAE J1939, SAE J1708, and combinations thereof. However, embodiments of the present disclosure may be implemented using other types of currently existing or yet-to-be-developed in-vehicle communication systems without departing from the scope of the claimed subject matter.

Figure 5A:
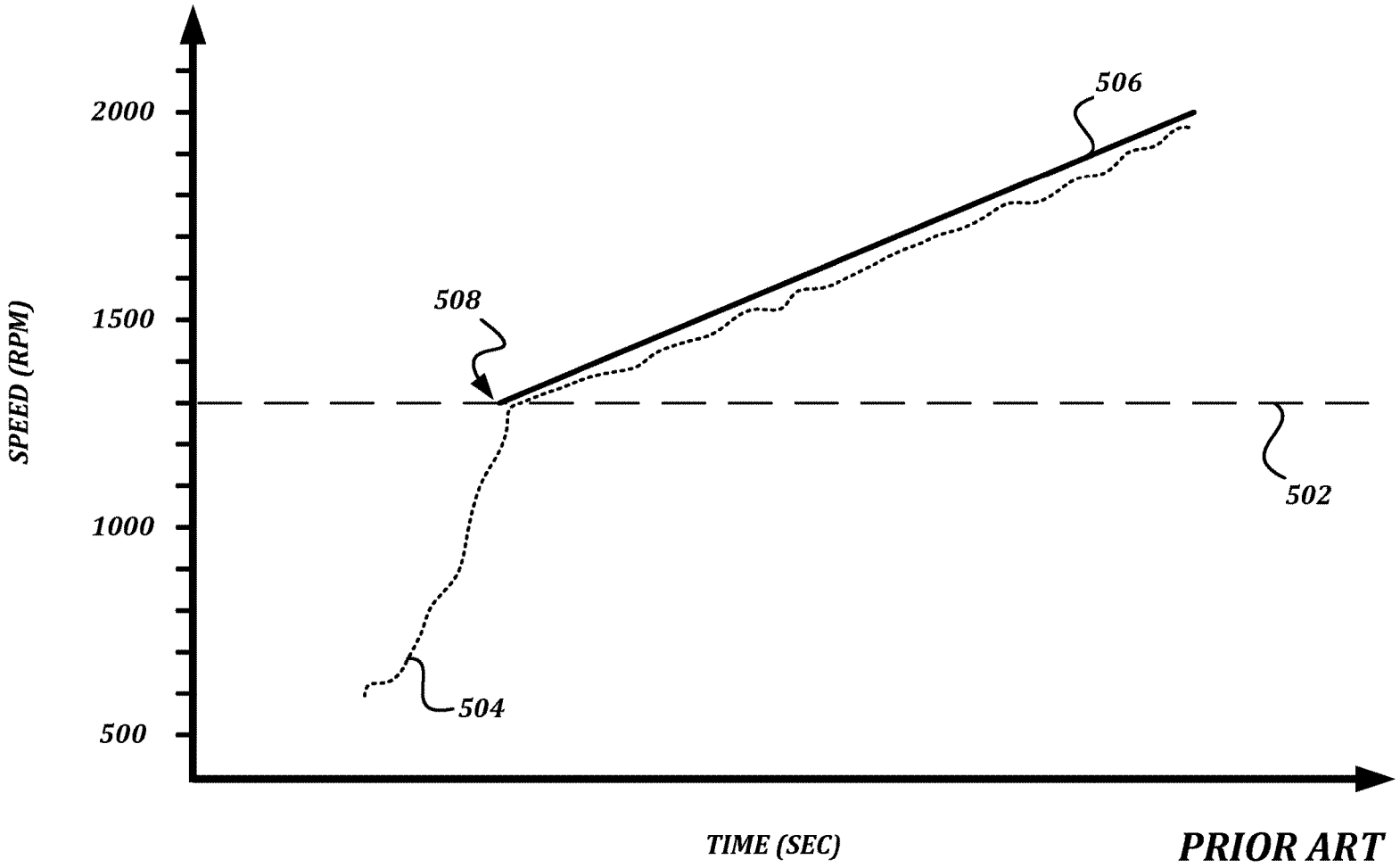
PRIOR ART FIG. 5A
FIG. 5A is a chart that illustrates typical behavior of a prior art system that generated dynamic engine speed limit values.

FIG. 5A is a chart that illustrates typical behavior of a prior art system that generated dynamic engine speed limit values. One example of a prior art system that exhibited the illustrated behavior in some embodiments is shown in commonly owned U.S. Pat. No. 8,406,971, the entire disclosure of which is hereby incorporated by reference herein for all purposes. Time is illustrated along the X-axis of the chart, and engine speed is illustrated along the Y-axis of the chart. A governor activation threshold value 502 is established at about 1300 RPM, after which an ECU begins generating a dynamic engine speed limit based on the current transmission ratio. The current engine speed 504 is illustrated using a dashed line, and the generated dynamic engine speed limit 506 is illustrated as a solid line.

Initially, the current engine speed 504 is increasing at a fast rate, until it crosses the governor activation threshold value 502 at point 508. Thereafter, a dynamic engine speed limit 506 is established, and is increased over time according to the engine speed control target slope. Accordingly, the rate of increase of the current engine speed is limited to the rate of increase allowed by the engine speed control target slope.

Figure 5B:
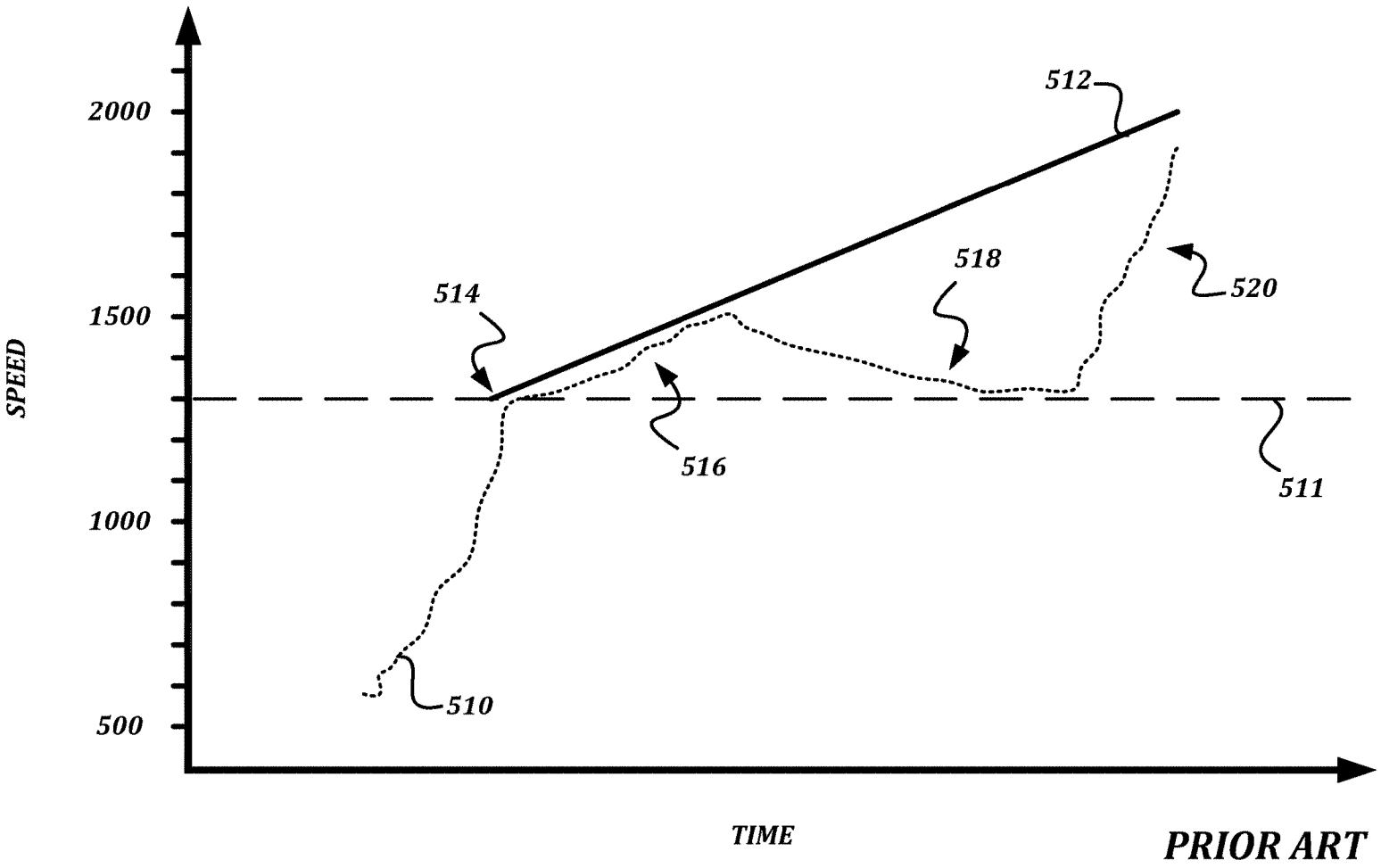
PRIOR ART FIG. 5B
FIG. 5B is a chart that illustrates a typical problem in the prior art that occurs during actual vehicle operation.

While this works in the trivial case illustrated in FIG. 5A where engine speed is constantly increasing, problems occur in many cases during actual driving behavior. FIG. 5B is a chart that illustrates a typical problem in the prior art that occurs during actual vehicle operation. The current engine speed 510 is again illustrated as a dashed line, and the dynamic engine speed limit 512 is illustrated as a solid line. As with the situation illustrated in FIG. 5A, the current engine speed 510 is initially increasing very quickly until it reaches the governor activation threshold value 511 at point 514, after which the dynamic engine speed limit 512 limits the rate of increase by the engine speed control target slope. During an initial period 516, this limits the rate of increase of the current engine speed 510, as expected. However, during a second period 518, the driver torque demand falls, and so the current engine speed 510 falls back toward the governor activation threshold value 511. Despite the reduced current engine speed 510, the dynamic engine speed limit 512 continues to rise, because it is merely based on time and the engine speed control target slope. After some time, the driver is able to rapidly increase the current engine speed 510 during a third period 520 because the dynamic engine speed limit 512 continued to increase over time. By backing off of the throttle after the dynamic engine speed limit 512 had been activated, drivers were able to avoid the naively calculated dynamic engine speed limit 512 of the prior art in order to access unlimited acceleration. What is desired are techniques that obtain the benefits related to reducing acceleration through the use of dynamic engine speed limits that both maintain drivability and also do not allow drivers unlimited acceleration after the dynamic engine speed limit has been activated.

Figure 6A:
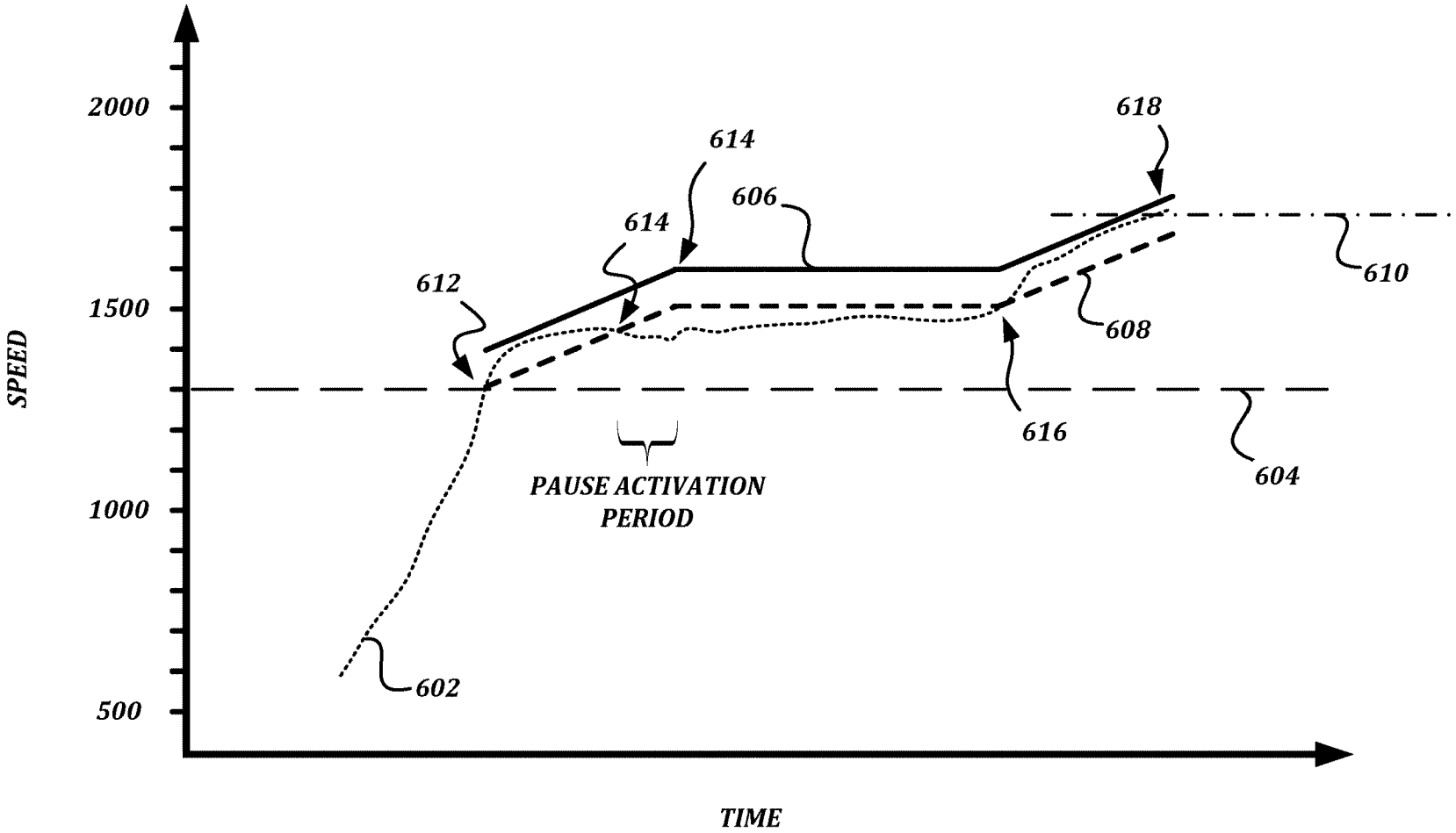
FIG. 6A is a chart that illustrates example behavior of some embodiments of improved speed control management techniques according to various aspects of the present disclosure.

FIG. 6A is a chart that illustrates example behavior of some embodiments of improved speed control management techniques according to various aspects of the present disclosure. In some embodiments, the problems discussed above are mitigated by providing for a "pause" in the increase of the dynamic engine speed limit when driver torque demand and/or the current engine speed with respect to the dynamic engine speed limit falls below a predetermined threshold. As illustrated, the chart includes a dynamic engine speed limit 606 and an offset dynamic engine speed limit 608. The dynamic engine speed limit 606 is used to control the engine speed, and the offset dynamic engine speed limit 608 is used to determine whether to continue to raise the dynamic engine speed limit 606.

As shown, the current engine speed value 602 increases in an unbound manner until it reaches the governor activation threshold value 604 at point 612. A dynamic engine speed limit 606 is then established based on the current transmission ratio at point 612. An offset dynamic engine speed limit 608 is also established at point 612. The offset dynamic engine speed limit 608 may be determined directly from the current transmission ratio, or may be determined indirectly as a given amount below the dynamic engine speed limit 606.

As long as the current engine speed value 602 remains between the dynamic engine speed limit 606 and the offset dynamic engine speed limit 608, the dynamic engine speed limit 606 and the offset dynamic engine speed limit 608 will be increased according to the engine speed control target slope. However, at point 614, the current engine speed value 602 has crossed below the offset dynamic engine speed limit 608. Accordingly, a timer is started to measure a time period for which the current engine speed value 602 is below the offset dynamic engine speed limit 608. After the timer has determined that a pause activation period has elapsed, at point 614, the dynamic engine speed limit 606 and the offset dynamic engine speed limit 608 are held constant instead of increasing. At point 616, the current engine speed value 602 has once again crossed above the offset dynamic engine speed limit 608. Accordingly, the dynamic engine speed limit 606 and the offset dynamic engine speed limit 608 are once again increased according to the engine speed control target slope.

In some embodiments, the dynamic engine speed limit 606 may be used until reaching a progressive shift limit 610. Once the current engine speed value 602 reaches the progressive shift limit 610, a progressive shift system may suggest (or force) the driver to shift into a higher gear in order to continue accelerating. One example of a system wherein an indicator is presented to a driver to prompt a shift into a higher gear is disclosed in commonly owned U.S. Pat. No. 8,587,423, the entire disclosure of which is hereby incorporated by reference herein for all purposes. In some embodiments, the engine speed control target slope may be decreased as the dynamic engine speed limit 606 approaches the progressive shift limit 610. Though not illustrated in FIG. 6A, it is clear that decreasing the engine speed control target slope could cause the rate of change of the current engine speed value 602 to get smaller, such that the current engine speed value 602 may be prevented from crossing above the progressive shift limit 610.

Pausing the increase of the dynamic engine speed limit 606 helps address the unbound acceleration problem that was present in the prior art, at least because not as much room will be available under the dynamic engine speed limit 606 after the current engine speed value 602 remains steady or falls. Pausing the increase of the dynamic engine speed limit 606 may be used in some embodiments instead of allowing the dynamic engine speed limit 606 to fall along with the current engine speed value 602 at least because the gap between the paused dynamic engine speed limit 606 and the current engine speed value 602 creates a power reserve that can be used to avoid torque binding. The use of an offset dynamic engine speed limit 608 may help to solve this problem as well. The offset dynamic engine speed limit 608 and the pause activation period also provide hysteresis and prevent the functionality from cycling rapidly.

Figure 6B:
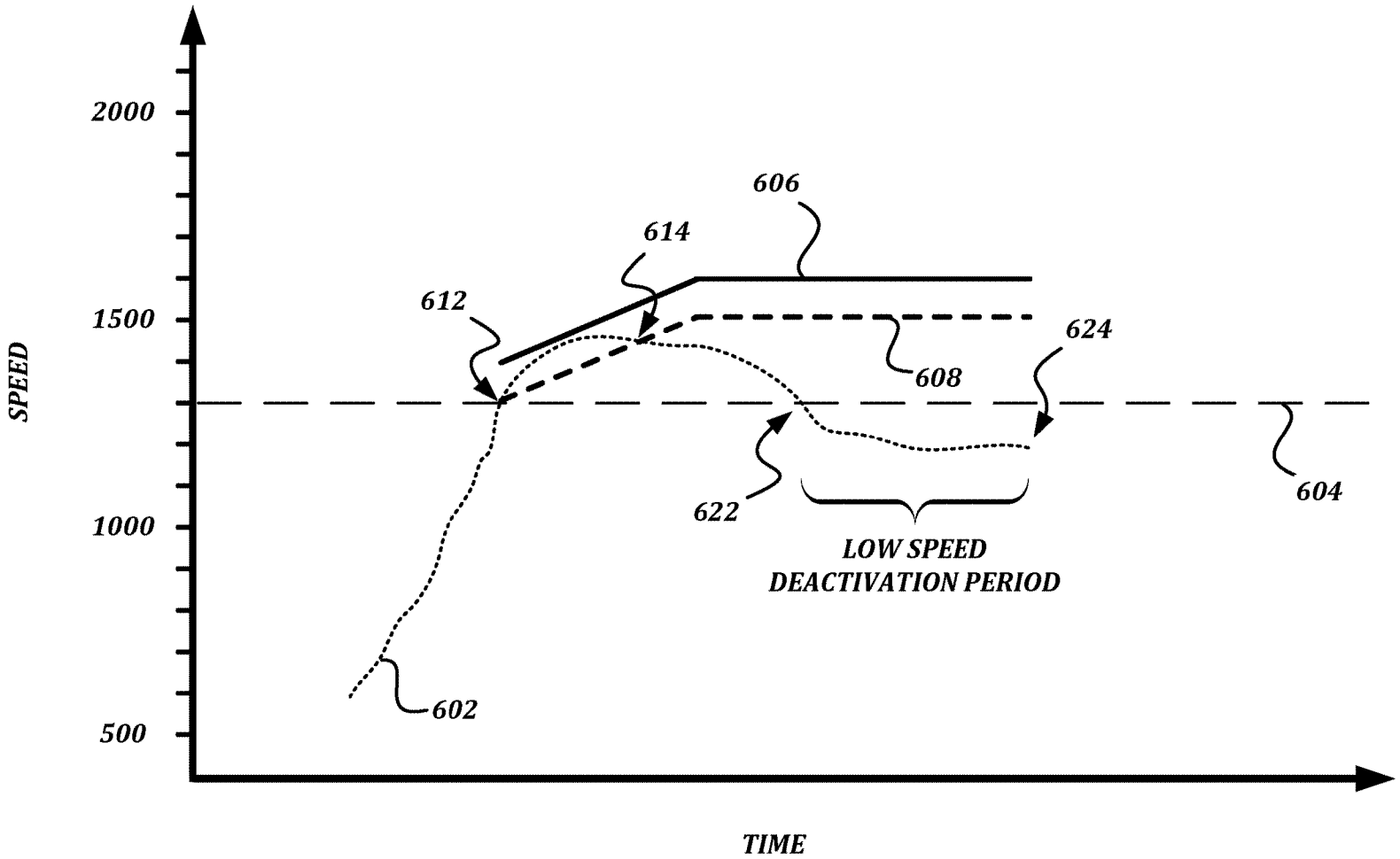
FIG. 6B is a chart that illustrates further example behavior of some embodiments of improved speed control management techniques according to various aspects of the present disclosure.

Though pausing the increase of the dynamic engine speed limit does help prevent drivers from avoiding the acceleration limits by reducing torque demand, other techniques could be used by drivers to obtain greater-than-desirable acceleration. For example, even though the increase of the dynamic engine speed limit pauses, a driver could continue to reduce torque demand, thus allowing greater acceleration back up to the paused offset dynamic engine speed limit. FIG. 6B is a chart that illustrates further example behavior of some embodiments of improved speed control management techniques according to various aspects of the present disclosure. The example behavior illustrated in FIG. 6B helps mitigate the effect of a driver continuing to reduce torque demand during the pause of the dynamic engine speed limit.

As in the chart of FIG. 6A, the current engine speed value 602 initially rises rapidly, until it crosses the governor activation threshold value 604 at point 612. Thereafter, the dynamic engine speed limit 606 and the offset dynamic engine speed limit 608 are set, and increase according to the engine speed control target slope. At point 614, the current engine speed value 602 crosses below the offset dynamic engine speed limit 608, and as illustrated in FIG. 6A, the increases in the dynamic engine speed limit 606 and the offset dynamic engine speed limit 608 are paused after a pause activation period has elapsed.

As illustrated, the current engine speed value 602 continues to fall, and at point 622, it falls below the governor activation threshold value 604. Thereafter, the timer begins measuring the amount of time for which the current engine speed value 602 has remained below the governor activation threshold value 604. Once the current engine speed value 602 has remained below the governor activation threshold value 604 for a low speed deactivation period, at point 624, the dynamic engine speed limit 606 and the offset dynamic engine speed limit 608 are no longer applied.

The use of a low speed deactivation period as illustrated in FIG. 6B may solve problems by helping to avoid rapid cycling of the functionality. In some embodiments, the low speed deactivation period may be relatively short in order to avoid cruising for a long period of time without resetting the dynamic engine speed limit, and/or to avoid the current engine speed dropping far below the governor activation threshold value.

Figure 6C:
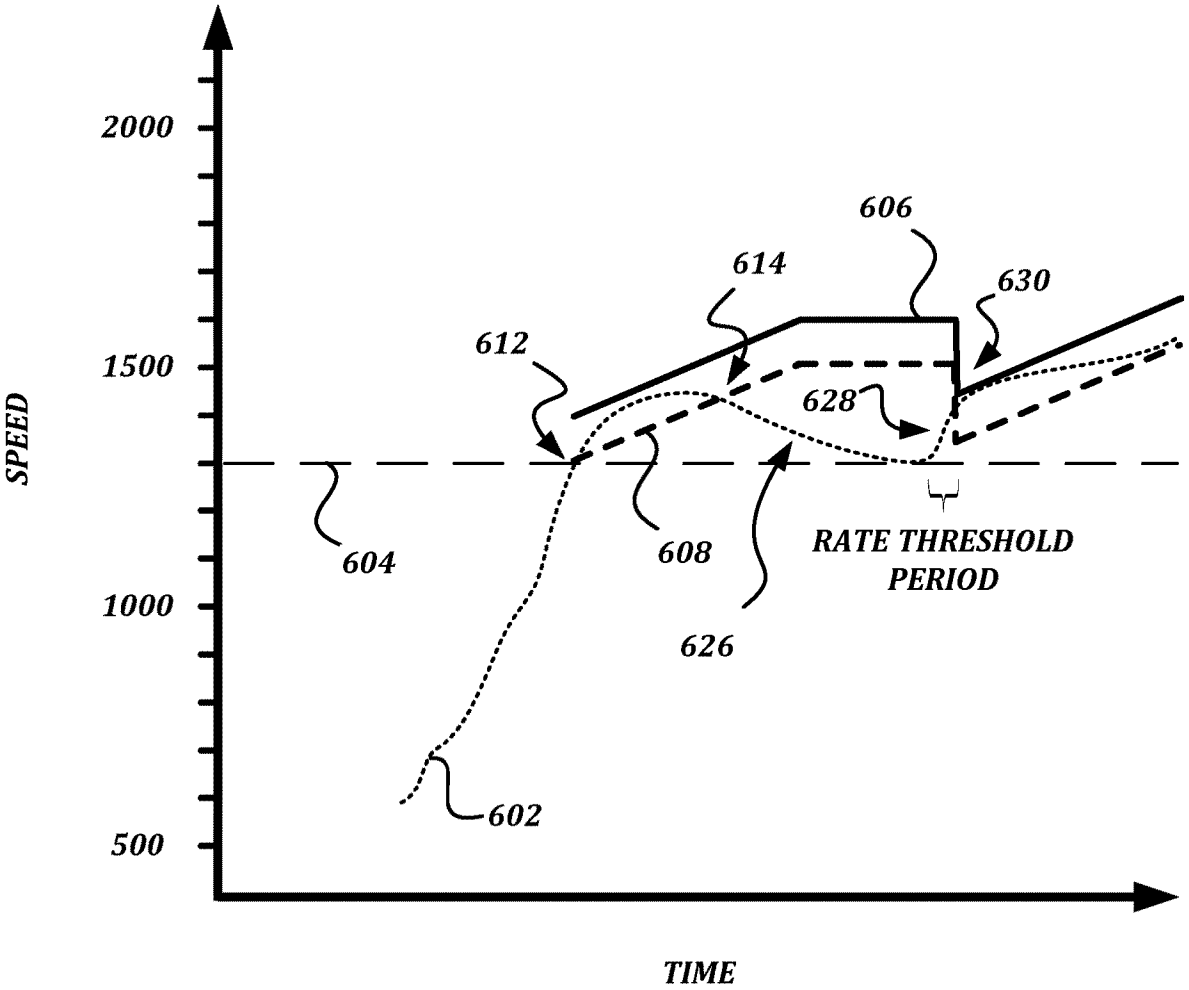
FIG. 6C is a chart that illustrates further example behavior of some embodiments of improved speed control management techniques according to various aspects of the present disclosure.
Figure 7A:
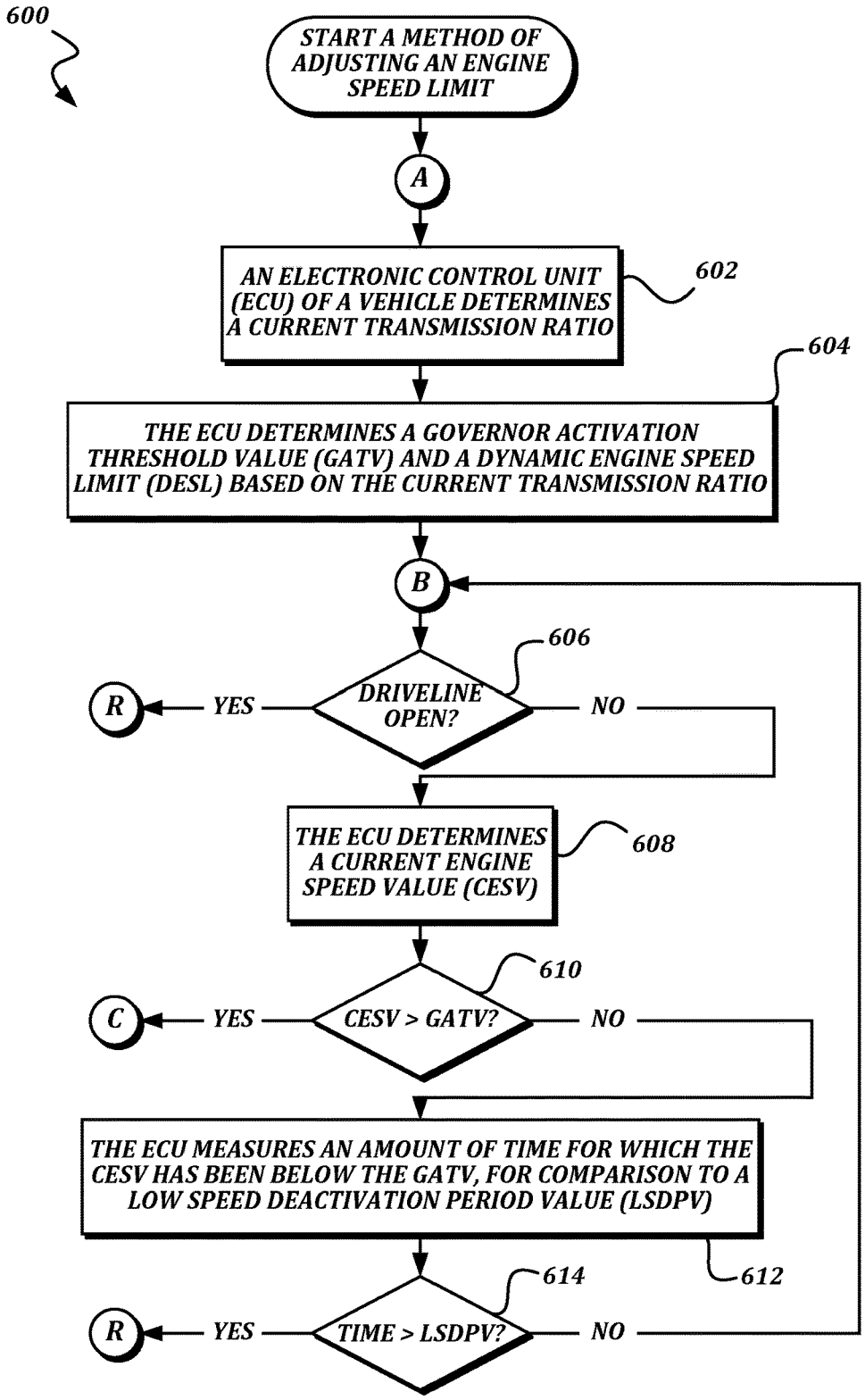
FIGS. 7A-7D are a flowchart that illustrates an example embodiment of a method of adjusting an engine speed limit according to various aspects of the present disclosure.
Figure 7B:
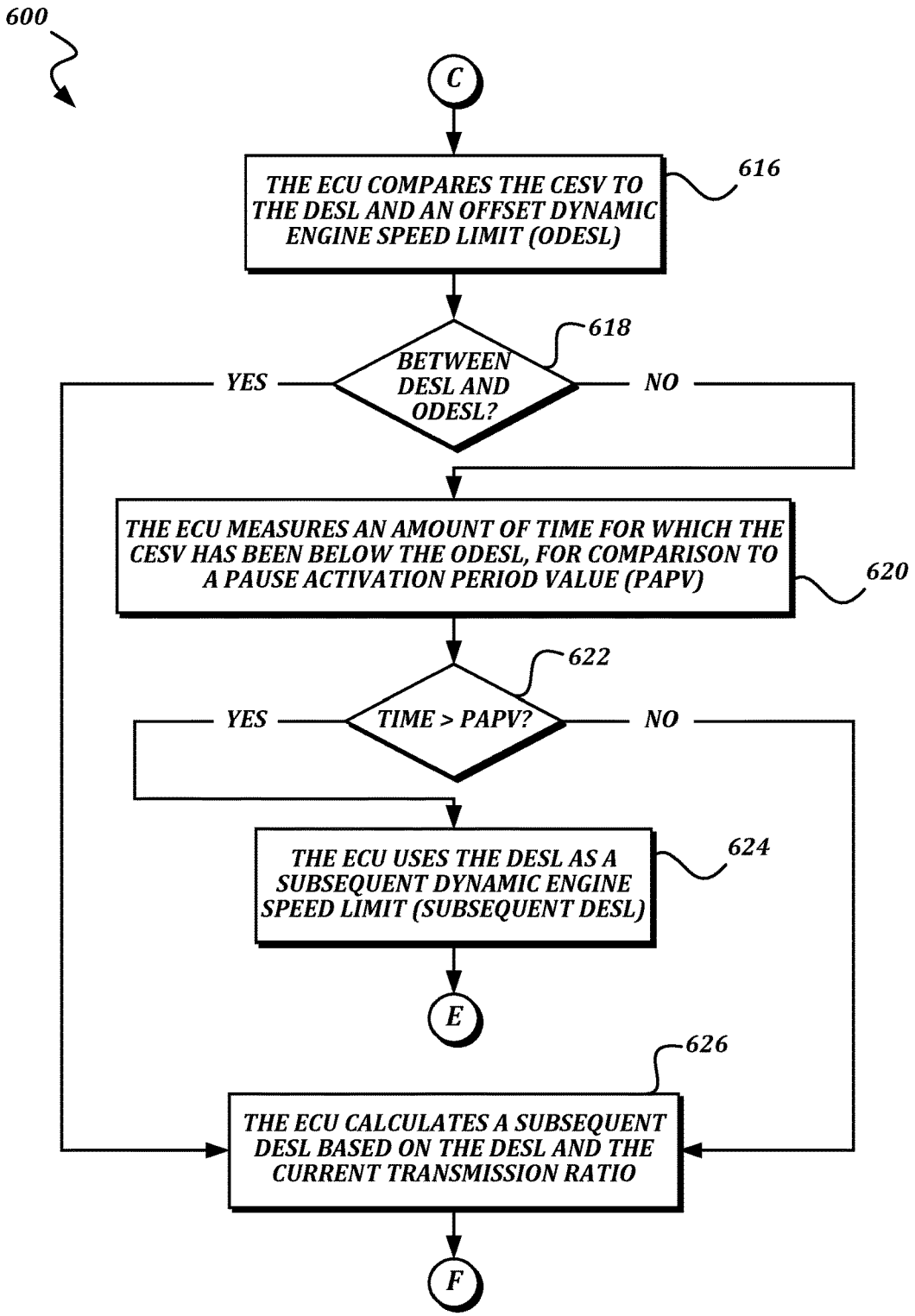
Figure 7C:
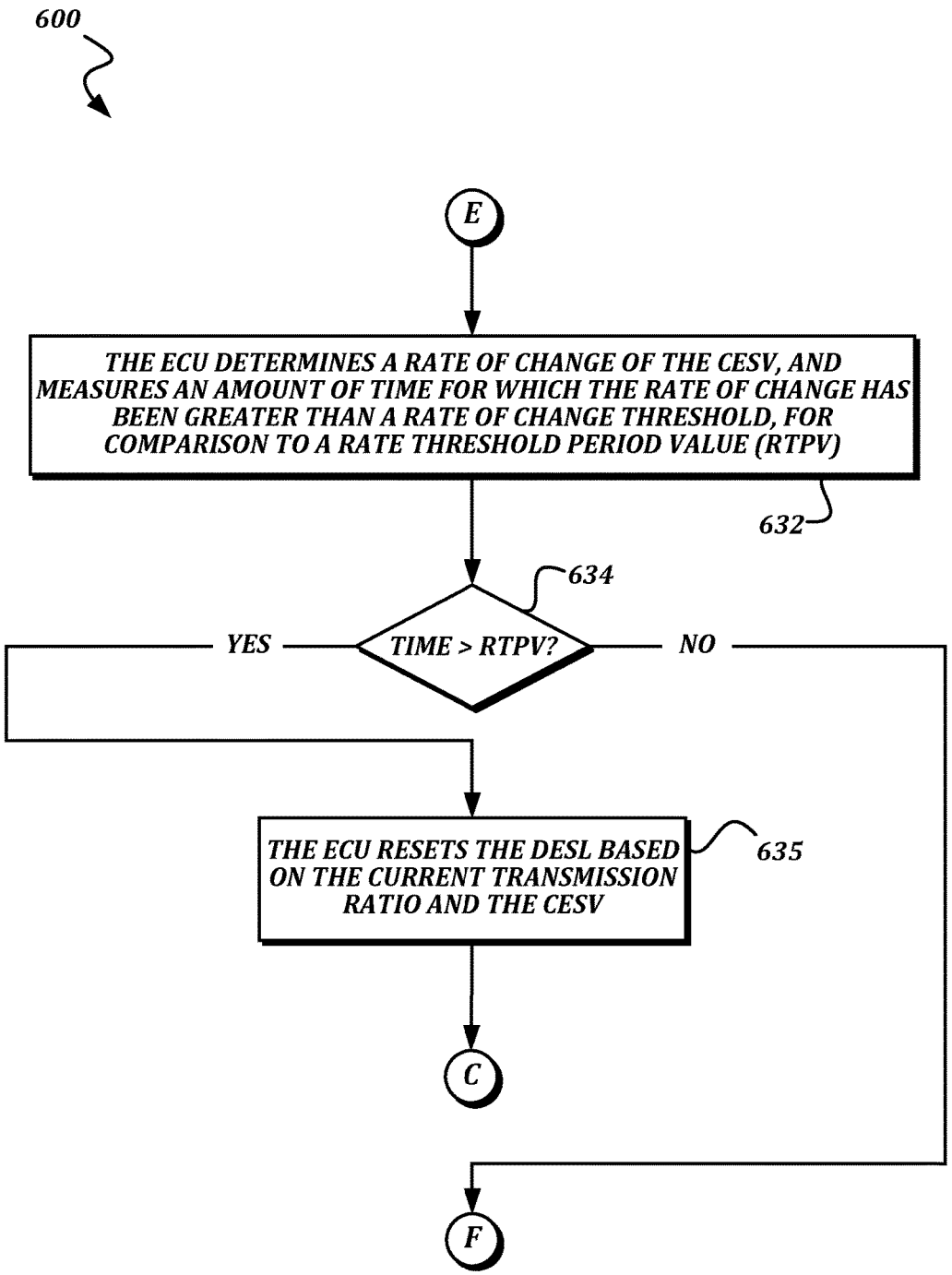
Figure 7D:
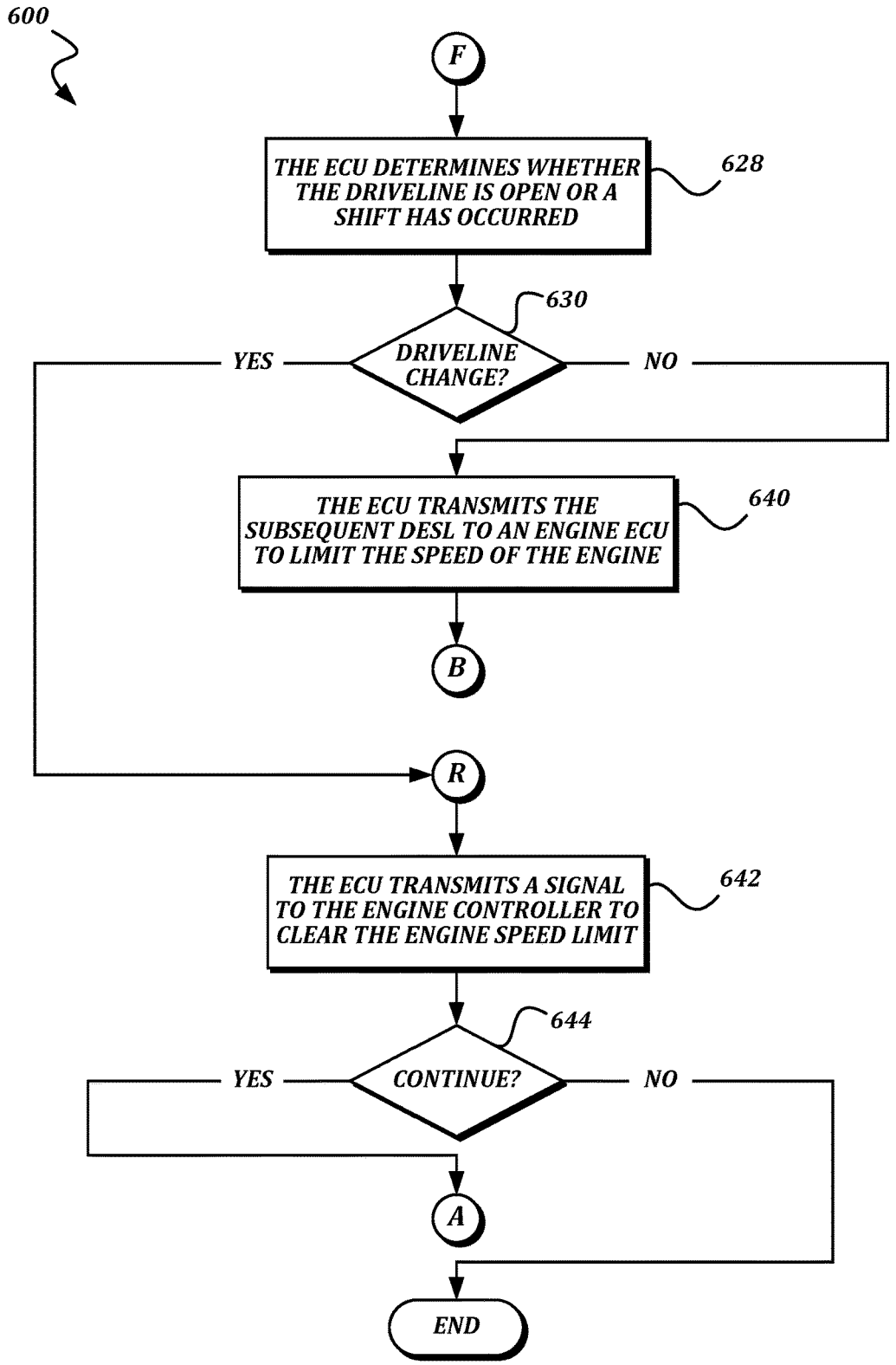

Even with the techniques above to limit the amount of acceleration, a driver may still be able to request a large amount of acceleration after allowing the current engine speed to drop below the offset dynamic engine speed limit. While allowing some such acceleration may be desirable for driveability (such as, for example, providing a power reserve for avoiding torque lock), some embodiments of the present disclosure may try to avoid allowing too much rapid acceleration. FIG. 6C is a chart that illustrates further example behavior of some embodiments of improved speed control management techniques according to various aspects of the present disclosure. The example behavior illustrated in FIG. 6C helps limit the amount of rapid acceleration a driver may obtain even when operating between the offset dynamic engine speed limit and the governor activation threshold value.

As with the previous charts, the current engine speed value 602 initially rises rapidly, until it crosses the governor activation threshold value 604 at point 612. After point 612, a dynamic engine speed limit 606 and an offset dynamic engine speed limit 608 are established, and are increased over time by an engine speed control target slope. Once the current engine speed value 602 drops below the offset dynamic engine speed limit 608, a timer starts to measure the amount of time that the current engine speed value 602 has been below the offset dynamic engine speed limit 608. At point 626, the pause activation period has elapsed, and the dynamic engine speed limit 606 and the offset dynamic engine speed limit 608 are held steady.

After point 626, the current engine speed value 602 continues to fall, but does not cause any other deactivation conditions to be triggered. Thereafter, at point 628, the driver requests a larger amount of torque, and the current engine speed value 602 begins to increase rapidly. Once the ECU detects that the current engine speed value 602 is increasing faster than a rate of change threshold, a timer is started to measure the amount of time for which the current engine speed value 602 has been increasing faster than the rate of change threshold. Upon determining that the rate of change has remained high for a rate threshold period, at point 630, the dynamic engine speed limit 606 and offset dynamic engine speed limit 608 are reset based on the current transmission ratio, as occurred at point 612. Thereafter, the rate of change will again be limited as intended.

The use of a rate threshold period as illustrated in FIG. 6C provides various benefits. For example, allowing temporary availability of high amounts of acceleration can help to improve drivability, but ending the availability after the rate threshold period elapses helps achieve the fuel efficiencies of limiting engine speed in the first place.

FIGS. 7A-7D are a flowchart that illustrates an example embodiment of a method of adjusting an engine speed limit according to various aspects of the present disclosure. From a start block, the method 700 proceeds through a continuation terminal ("terminal A") to block 702, where an electronic control unit (ECU) 402 of a vehicle 10 determines a current transmission ratio. The ECU 402 may use any suitable technique to determine the current transmission ratio. For example, the ECU 402 may derive the current transmission ratio using a current engine speed received from the engine speed sensor 64 and an output shaft speed received from the output shaft sensor 66. As another example, the ECU 402 may derive the current transmission ratio using a current engine speed received from the engine speed sensor 64 and a wheel speed received from the wheel speed sensor 68, along with a rear axle ratio value. As yet another example, the ECU 402 may receive the current transmission ratio value from a drive line condition detector 260.

At block 704, the ECU 402 determines a governor activation threshold value (GATV) and a dynamic engine speed limit (DESL) based on the current transmission ratio. In some embodiments, the ECU 402 may use the current transmission ratio to retrieve the governor activation threshold value and/or the dynamic engine speed limit from a look-up table 430. In some embodiments, the ECU 402 may use a formula to calculate the governor activation threshold value and/or the dynamic engine speed limit based on the current transmission ratio.

The method 700 then proceeds to another continuation terminal ("terminal B"), and then to a decision block 706. At decision block 706, a determination is made as to whether a driveline of the vehicle 10 is open (e.g., if the clutch mechanism 16 is fully or partially disengaged). Any suitable technique for determining whether the driveline of the vehicle 10 is open may be used. For example, in some embodiments, the ECU 402 may receive a signal from the clutch mechanism 16 or the clutch pedal position sensor 54 indicating that the clutch mechanism 16 is disengaged. As another example, in some embodiments, the ECU 402 may receive a signal from the drive line condition detector 260 indicating that the driveline is open. As yet another example, in some embodiments, the ECU 402 may determine that the driveline is open based on a comparison of the current engine speed to the output shaft speed received from the output shaft sensor 66 and a finding that it does not correlate to any transmission ratio provided by the transmission 14.

If it is determined that the driveline is open, then the result of decision block 706 is YES, and the method 700 proceeds to a continuation terminal ("terminal R"). Otherwise, if it is determined that the driveline is closed, then the result of decision block 706 is NO, and the method 700 proceeds to block 708. At block 708, the ECU 402 determines a current engine speed value (CESV). Any suitable technique may be used by the ECU 402 to determine the current engine speed value. For example, in some embodiments, the ECU 402 may receive the current engine speed value from the engine speed sensor 64. As another example, in some embodiments, the ECU 402 may receive the current engine speed value from the engine ECU 460.

At decision block 710, a determination is made as to whether the current engine speed value is greater than the governor activation threshold value. If it is determined that the current engine speed value is greater than the governor activation threshold value, then the result of decision block 710 is YES, and the method 700 proceeds to a continuation terminal ("terminal C"). Otherwise, if the current engine speed value is less than or equal to the governor activation threshold value, then the result of decision block 710 is NO, and the method 700 proceeds to block 712.

Once the method 700 has arrived at block 712, the driveline is closed, but the current engine speed value is not greater than the governor activation threshold value. At this point, the method 700 considers whether the engine speed limit should be cleared. Accordingly, at block 712, the ECU 402 measures an amount of time for which the current engine speed value has been below the governor activation threshold value. This amount of time is measured for comparison to a low speed deactivation period value (LSDPV). Any suitable technique may be used to measure the amount of time. In some embodiments, the ECU 402 may measure the amount of time by starting a timer the first time that the actions of block 712 are performed, and then checking the value of the timer when the actions of block 712 are performed again. In some embodiments, the ECU 402 may store a timestamp the first time that the actions of block 712 are performed, and may measure the time that has elapsed since the stored timestamp when the actions of block 712 are performed again.

The method 700 then proceeds to decision block 714, where a determination is made as to whether the amount of time for which the current engine speed value has been below the governor activation threshold value is greater than the low speed deactivation period value. If it is determined that the amount of time is greater than the low speed deactivation period value, then the result of decision block 714 is YES, and the method 700 proceeds to a continuation terminal ("terminal R").

Otherwise, if the amount of time for which the current engine speed value has been below the governor activation threshold value is not greater than the low speed deactivation period value, then the result of decision block 714 is NO, and the method 700 returns to terminal B. In this way, the method 700 will loop through blocks 706-714 until either the current engine speed value is greater than the governor activation threshold value (in which case the result of decision block 710 will be YES and the method 700 will jump to terminal C to determine and apply an engine speed limit value), or until the driveline is open or the low speed deactivation period passes (in which case the result of decision block 706 or 714, respectively, will be YES and the method 700 will jump to terminal R to clear the engine speed limit).

As discussed above, if the current engine speed value is greater than the governor activation threshold value, the result of decision block 710 will be YES and the method 700 will proceed to terminal C. From terminal C (FIG. 7B), the method 700 proceeds to block 716, where the ECU 402 compares the current engine speed value to the dynamic engine speed limit and an offset dynamic engine speed limit (ODESL). The offset dynamic engine speed limit may be determined using any suitable technique. For example, in some embodiments, the offset dynamic engine speed limit may be set to a fixed amount less than the dynamic engine speed limit. As another example, in some embodiments, the offset dynamic engine speed limit may be separately determined based on one or more of the dynamic engine speed limit, the current transmission ratio, and the current engine speed value.

At decision block 718, a determination is made based on the comparison performed by the ECU 402 regarding whether the current engine speed value is between the dynamic engine speed limit and the offset dynamic engine speed limit. Due to the fact that the dynamic engine speed limit is used to limit the engine speed, the vehicle 10 should not end up in a situation where the current engine speed is above the dynamic engine speed limit. Accordingly, the possibilities for the state of the vehicle 10 at this point in the method 700 are that the current engine speed value is either between the dynamic engine speed limit and the offset dynamic engine speed limit, or the current engine speed value is below the offset dynamic engine speed limit. If the current engine speed value is between the dynamic engine speed limit and the offset dynamic engine speed limit, then the result of decision block 718 is YES and the method 700 proceeds to block 726. Otherwise, if the current engine speed value is not between the dynamic engine speed limit and the offset dynamic engine speed limit, then the result of decision block 718 is NO and the method 700 proceeds to block 720.

At block 720, the ECU 402 measures an amount of time for which the current engine speed value has been below the offset dynamic engine speed limit. This amount of time is measured for comparison to a pause activation period value (PAPV). As with the time measurement described in block 712, any suitable technique may be used to measure the amount of time. In some embodiments, the ECU 402 may measure the amount of time by starting a timer the first time that the actions of block 720 are performed, and then checking the value of the timer when the actions of block 720 are performed again. In some embodiments, the ECU 402 may store a timestamp the first time that the actions of block 720 are performed, and may measure the time that has elapsed since the stored timestamp when the actions of block 720 are performed again.

The method 700 then proceeds to decision block 722, where a determination is made as to whether the amount of time for which the current engine speed value has been below the offset dynamic engine speed limit is greater than the pause activation period value. If so, then the result of decision block 722 is YES, and the method 700 proceeds to block 724. At block 724, the ECU 402 uses the dynamic engine speed limit as a subsequent dynamic engine speed limit (subsequent DESL). In other words, the ECU 402 does not increase the dynamic engine speed limit, but instead pauses or holds it at the previous value. From block 724, the method 700 proceeds to a continuation terminal ("terminal E") to check to see if a rate of change of the current engine speed value indicates that the dynamic engine speed limit should be reset before it is applied, as described further below.

Returning to decision block 722, if the amount of time for which the current engine speed value has been below the offset dynamic engine speed limit is not greater than the pause activation period value, then the result of decision block 722 is NO, and the method 700 proceeds to block 726. At block 726, the ECU 402 calculates a subsequent dynamic engine speed limit based on the dynamic engine speed limit and the current transmission ratio. In other words, the ECU 402 increases the dynamic engine speed limit.

Any suitable technique may be used by the ECU 402 to determine how much to increase the dynamic engine speed limit. For example, in some embodiments, the ECU 402 may consult a look-up table 430 to find an engine speed target slope that corresponds to the current transmission ratio, and the engine speed target slope may be used to determine the amount to increase the dynamic engine speed limit. As another example, in some embodiments, the ECU 402 may use a defined function that calculates the amount to increase the dynamic engine speed limit based on one or more of the current transmission ratio, the current engine speed value, a progressive shift target, and/or the like. As yet another example, in some embodiments, the ECU 402 may consider an amount of time and/or the current value of the dynamic engine speed limit to vary the slope, such as by reducing the slope over time or as the dynamic engine speed limit approaches a progressive shift target. From block 726, the method 700 proceeds to a continuation terminal ("terminal F").

From terminal E (FIG. 7C), the method 700 proceeds to block 732. At block 732, the ECU 402 determines a rate of change of the current engine speed value, and measures an amount of time for which the rate of change has been greater than a rate of change threshold. The amount of time measured may then be compared to a rate threshold period value (RTPV). The rate of change may be determined using any suitable technique, such as by comparing a previous engine speed value to the current engine speed value and dividing by the time elapsed between the two readings. As with blocks 712 and 720, the ECU 402 may measure the amount of time using any suitable technique, such as starting a timer or storing a timestamp upon the first time through block 732, and then incrementing the timer or comparing the current time to the stored timestamp upon subsequent times through block 732. If the rate of change was determined to not be higher than the rate of change threshold, then the amount of time measured may be considered to be zero.

At decision block 734, a determination is made as to whether the amount of time for which the rate of change has been greater than the rate of change threshold is greater than the rate threshold period value. If so, then the result of decision block 734 is YES, and the method 700 proceeds to block 735, where the ECU 402 resets the dynamic engine speed limit based on the current transmission ratio and the current engine speed value. The reset dynamic engine speed limit could be based on the current transmission ratio alone, but this could run into problems when the current engine speed value is already higher than the original dynamic engine speed limit for the current transmission ratio. The method 700 then returns to terminal C to use the reset dynamic engine speed limit. Otherwise, if the rate of change is not greater than the rate of change threshold, or if the amount of time for which the rate of change has been greater than the rate of change threshold is not greater than the rate threshold period value, then the result of decision block 734 is NO, and the method 700 proceeds to a continuation terminal ("terminal F").

From terminal F (FIG. 7D), the method 700 proceeds to block 728, where the ECU 402 determines whether the driveline is open or a shift has occurred. The ECU 402 may use any suitable technique to determine whether the driveline is open, including but not limited to those techniques discussed above with respect to block 706. The ECU 402 may use any suitable technique to determine whether a shift has occurred. In some embodiments, the ECU 402 may determine an updated transmission ratio using a technique such as those discussed above with respect to block 702, and may compare the updated transmission ratio to the current transmission ratio determined in block 702 to determine if a shift has occurred. Though the method 700 does check to see if the driveline is open, it may be desirable to also use the updated transmission ratio to determine if a shift has occurred, because a shift could have occurred without opening the driveline.

At decision block 730, a determination is made based on whether or not the ECU 402 had determined that the driveline had changed or was open. If the ECU 402 determined that the driveline had changed or was open, then the result of decision block 730 is YES, and the method 700 proceeds to a continuation terminal ("terminal R"). Otherwise, if the ECU 402 determined that the driveline had not changed and was closed, then the result of decision block 730 is NO, and the method 700 proceeds to block 740. At block 740, the ECU 402 transmits the subsequent dynamic engine speed limit to an engine ECU 460 to limit the speed of the engine. The method 700 then loops back to terminal B.

If the method 700 had arrived at terminal R, the method 700 then proceeds to block 742, where the ECU 402 transmits a signal to the engine ECU 460 to clear the engine speed limit. In some embodiments, the transmission of the dynamic engine speed limit in block 740 and the clearing of the engine speed limit in block 742 may use similar techniques. In some embodiments, both may constitute transmitting a TSC1 engine speed limit via a J1939-71 signal. The TSC1 engine speed limit value may be the subsequent dynamic engine speed limit when setting the engine speed limit in block 740, and may be a maximum value or an out-of-bounds value when clearing the engine speed limit in block 742. When the engine ECU 460 receives the engine speed limit, it may convert the engine speed limit to a torque limit, a fuel limit, or any other suitable value in order to implement the engine speed limit.

From block 742, the method 700 proceeds to a decision block 744, where a determination is made regarding whether to continue to adjust the engine speed limit. In most cases, the method 700 will continue as long as the vehicle 10 is operating and the functionality is enabled via one or more driver settings. Accordingly, if the method 700 is to continue operating, then the result of decision block 744 is YES, and the method 700 returns to terminal A. Otherwise, if the method 700 is to stop, then the result of decision block 744 is NO, and the method 700 proceeds to an end block to terminate.

Overall, the above method 700 is described as a control loop. As is typical for control loops in an ECU 402, the steps of the method 700 may be executed once per control cycle in order to continually update the dynamic engine speed limit while the vehicle 10 is running. In some embodiments, the steps of the method 700 may be executed at a rate of about once every 200 ms, though other suitable rates may be used instead.

The above description of the method 700 refers to it being executed by the ECU 402, which is illustrated in FIG. 4. One of ordinary skill in the art will recognize that, in some embodiments, the method 700 could be executed by any of the other ECUs 202, 202', 302 illustrated in FIG. 2A, 2B, or 3, or could be executed by an ECU that has some combination of features illustrated in any of the ECUs 202, 202', 302, 402.

The above description of the method 700 refers to tests that various values are greater than, longer than, or between other values. The terms "greater than," "longer than," and "between" were used without further explanation for clarity of the above description. In some embodiments of the method 700, the values may be compared to determine if they are "greater than or equal to" or "longer than or equal to" the other values instead of strictly "greater than" or "longer than" the other values. Likewise, in some embodiments of the method 700, testing whether a value is between two other values may include testing whether a value is between two other values or is equal to one of the two other values.

While illustrative embodiments have been illustrated and described, it will be appreciated that various changes can be made therein without departing from the spirit and scope of the invention.

The embodiments of the invention in which an exclusive property or privilege is claimed are defined as follows:

1. A vehicle, comprising:

an engine that includes an engine electronic control unit (engine ECU);

a set of sensors that include an engine speed sensor, a vehicle speed sensor, and a throttle position sensor; and an electronic control unit (ECU) communicatively coupled to the engine ECU and the sensors;

wherein the ECU is configured to calculate and provide engine speed limit values to the engine ECU;

wherein calculating engine speed limit values includes:

detecting that an engine speed has increased beyond a governor activation threshold value;

determining a dynamic engine speed limit;

determining whether conditions for applying the dynamic engine speed limit are met; and while the conditions for applying the dynamic engine speed limit are met, repeatedly updating the dynamic engine speed limit to a subsequent dynamic engine speed limit; and wherein updating the dynamic engine speed limit includes:

determining a current engine speed value;

using a previous dynamic engine speed limit as the subsequent dynamic engine speed limit in response to determining that the current engine speed value is between the governor activation threshold value and an offset dynamic engine speed limit;

using a new dynamic engine speed limit as the subsequent dynamic engine speed limit in response to determining that the current engine speed value is between the previous dynamic engine speed limit and the offset dynamic engine speed limit; and transmitting the subsequent dynamic engine speed limit to the engine ECU of the engine for implementation.

2. The vehicle of claim 1, wherein updating the dynamic engine speed limit includes checking that the conditions for applying the dynamic engine speed limit are still met; and wherein checking that the conditions for applying the dynamic engine speed limit are still met includes at least one of:

detecting whether a shift has occurred;

detecting that a driveline is open; and measuring an amount of time for which the current engine speed value has been below the governor activation threshold value, and determining whether the amount of time is greater than a low speed deactivation period value.

3. The vehicle of claim 1, wherein determining that the current engine speed value is between the governor activation threshold value and the offset dynamic engine speed limit includes:

measuring an amount of time for which the current engine speed value has been between the governor activation threshold value and the offset dynamic engine speed limit; and determining whether the amount of time is greater than a pause activation period value.

4. The vehicle of claim 1, wherein updating the dynamic engine speed limit includes:

measuring an amount of time for which a rate of change of the current engine speed value has been greater than a rate of change threshold; and in response to determining that the amount of time is greater than a rate threshold period value, using a reset dynamic engine speed limit as the subsequent dynamic engine speed limit.

5. The vehicle of claim 1, further comprising, once the conditions for applying the dynamic engine speed limit are no longer met, transmitting a signal to the engine ECU to clear the engine speed limit.

6. The vehicle of claim 5, wherein the signal to the engine to clear the engine speed limit indicates an engine speed limit that is out of bounds of normal engine speed limit settings.

7. The vehicle of claim 1, wherein transmitting the subsequent dynamic engine speed limit to the engine for implementation comprises transmitting a TSC1 engine speed limit via a J1939-71 signal from the ECU to the engine to set an engine speed limit to be implemented by the engine.

8. The vehicle of claim 1, wherein determining a dynamic engine speed limit includes:

detecting a transmission ratio; and determining the dynamic engine speed limit based on the detected transmission ratio.

9. The vehicle of claim 1, wherein using a new dynamic engine speed limit includes calculating the new dynamic engine speed limit by increasing the previous dynamic engine speed limit by an amount based on the detected transmission ratio.

10. The vehicle of claim 9, wherein the amount by which the previous dynamic engine speed limit is increased is further based on the current engine speed.

11. A method, executed by an electronic control unit (ECU), of adjusting an engine speed limit for an engine of a vehicle, the method comprising:

detecting that an engine speed has increased beyond a governor activation threshold value;

determining a dynamic engine speed limit;

determining whether conditions for applying the dynamic engine speed limit are met; and while the conditions for applying the dynamic engine speed limit are met, repeatedly updating the dynamic engine speed limit to a subsequent dynamic engine speed limit, wherein updating the dynamic engine speed limit includes:

determining a current engine speed value;

using a previous dynamic engine speed limit as the subsequent dynamic engine speed limit in response to determining that the current engine speed value is between the governor activation threshold value and an offset dynamic engine speed limit;

using a new dynamic engine speed limit as the subsequent dynamic engine speed limit in response to determining that the current engine speed value is between the previous dynamic engine speed limit and the offset dynamic engine speed limit; and transmitting the subsequent dynamic engine speed limit to an engine electronic control unit (engine ECU) of the engine for implementation.

12. The method of claim 11, wherein updating the dynamic engine speed limit includes checking that the conditions for applying the dynamic engine speed limit are still met, and wherein checking that the conditions for applying the dynamic engine speed limit are still met includes at least one of:

detecting whether a shift has occurred;

detecting that a driveline is open; and measuring an amount of time for which the current engine speed value has been below the governor activation threshold value, and determining whether the amount of time is greater than a low speed deactivation period value.

13. The method of claim 11, wherein determining that the current engine speed value is between the governor activation threshold value and the offset dynamic engine speed limit includes:

measuring an amount of time for which the current engine speed value has been between the governor activation threshold value and the offset dynamic engine speed limit; and determining whether the amount of time is greater than a pause activation period value.

14. The method of claim 11, wherein updating the dynamic engine speed limit includes:

measuring an amount of time for which a rate of change of the current engine speed value has been greater than a rate of change threshold; and in response to determining that the amount of time is greater than a rate threshold period value, using a reset dynamic engine speed limit as the subsequent dynamic engine speed limit.

15. The method of claim 11, further comprising, once the conditions for applying the dynamic engine speed limit are no longer met, transmitting a signal to the engine ECU to clear the engine speed limit.

16. The method of claim 15, wherein the signal to the engine to clear the engine speed limit indicates an engine speed limit that is out of bounds of normal engine speed limit settings.

17. The method of claim 11, wherein transmitting the subsequent dynamic engine speed limit to the engine for implementation comprises transmitting a TSC1 engine speed limit via a J1939-71 signal from the ECU to the engine to set an engine speed limit to be implemented by the engine.

18. The method of claim 11, wherein determining a dynamic engine speed limit includes:

detecting a transmission ratio; and determining the dynamic engine speed limit based on the detected transmission ratio.

19. The method of claim 11, wherein using a new dynamic engine speed limit includes calculating the new dynamic engine speed limit by increasing the previous dynamic engine speed limit by an amount based on the detected transmission ratio.

20. The method of claim 19, wherein the amount by which the previous dynamic engine speed limit is increased is further based on the current engine speed.

* * * * *